United States Patent [19]

Murakami

[11] Patent Number: 5,032,876

[45] Date of Patent: Jul. 16, 1991

[54] SHEET FINISHER

[75] Inventor: Koichi Murakami, Yokohama, Japan

[73] Assignee: Canon Kabushiki Kaisha, Tokyo, Japan

[21] Appl. No.: 563,861

[22] Filed: Aug. 7, 1990

Related U.S. Application Data

[63] Continuation of Ser. No. 116,664, Nov. 4, 1987, abandoned.

[30] Foreign Application Priority Data

| | | | |
|---|---|---|---|
| Oct. 4, 1986 | [JP] | Japan | 61-263291 |
| Nov. 4, 1986 | [JP] | Japan | 61-263292 |
| Nov. 4, 1986 | [JP] | Japan | 61-263293 |
| Nov. 4, 1986 | [JP] | Japan | 61-263294 |
| Nov. 4, 1986 | [JP] | Japan | 61-263295 |
| Nov. 4, 1986 | [JP] | Japan | 61-263296 |
| Nov. 19, 1986 | [JP] | Japan | 61-277691 |

[51] Int. Cl.[5] ..... G03G 15/00

[52] U.S. Cl. ..... 355/324; 355/311; 355/322

[58] Field of Search ..... 355/324, 308, 309, 311, 355/322; 271/253, 226, 227

[56] References Cited

U.S. PATENT DOCUMENTS

| | | | |
|---|---|---|---|
| 2,732,206 | 1/1956 | Dietrich | 271/89 |
| 4,134,672 | 1/1979 | Burlew et al. | 355/3 SH |
| 4,200,386 | 4/1980 | Queener | 355/14 SH |
| 4,202,621 | 5/1980 | Yoshimura | 355/3 SH |
| 4,248,525 | 2/1981 | Sterrett | 355/14 SH |
| 4,313,670 | 2/1982 | Caldwell | 355/3 R |
| 4,361,393 | 11/1982 | Noto | 355/3 SH |
| 4,368,972 | 1/1983 | Naramore | 355/14 SH |
| 4,549,804 | 10/1985 | Braun | 355/14 SH |

FOREIGN PATENT DOCUMENTS

| | | |
|---|---|---|
| 122992 | 10/1984 | European Pat. Off. . |
| 59-224859 | 12/1984 | Japan . |
| 60-67105 | 4/1985 | Japan . |
| 60-205466 | 10/1985 | Japan . |
| 60-232372(A) | 11/1985 | Japan . |
| 61-112167 | 5/1986 | Japan . |
| 61-243465 | 10/1986 | Japan . |
| 2165823 | 4/1986 | United Kingdom . |

OTHER PUBLICATIONS

"Finisher Capable of Being Unloaded Without Interrupting Reproduction Device Operation", Anonymous Research Disclosure, vol. 264, p. 209, British Ref. No. 26449, Apr. 1986.

*Primary Examiner*—R. L. Moses

*Attorney, Agent, or Firm*—Fitzpatrick, Cella, Harper & Scinto

[57] ABSTRACT

A sheet finisher apparatus includes a stacker for stacking sheets, a stapler for stapling sheets, switching device for receiving sheets and conveying them selectively to the sheet stacker or to the stapler, a counter for counting number of sheets to the stapler, and controller for controlling the switching device to convey the sheets to the stapler until a count of the counter reaches a predetermined, and for conveying the sheets to the stacker thereafter.

32 Claims, 26 Drawing Sheets

SHEET FINISHER

This application is a continuation of application Ser. No. 116,664 filed Nov. 4, 1987, now abandoned.

FIELD OF THE INVENTION AND RELATED ART

The present invention relates to a sheet finisher usable with an image forming apparatus such as a copying machine, a printer and a laser beam printer, more particularly to a sheet finisher for processing the sheets, after images are formed on the sheets by an image forming means of said image forming apparatus, by for example, stacking, aligning, sorting, stapling and/or folding the sheets.

A sheet finisher comprising a stapler is known by which recording sheets discharged from an associated image forming apparatus are stacked and stapled. On the other hand, an image forming apparatus provided with an automatic original (document) feeder of circulation or recirculation type (RDF, RDH) which will hereinafter be called "RDF feeder" or an automatic document feeder of non-circulation type which will hereinafter be called "ADF feeder", are also known. When the stapler is used with such an image forming apparatus, it is general that after one circulation of the originals are fed from the RDF feeder or the ADF feeder to an image reading station where the originals are read, the recording sheets (copy sheets, for example) on which images are formed from the one set of the originals are stapled by the stapler of the sheet finisher. Naturally, however, there is a limitation that the maximum number of sheets which the stapler can staple, and therefore, an operator has to always care whether or not the number of originals set in the ADF or RDF feeder is less than the maximum number.

If the operator does not care the number of originals, the staple can be jammed due to the over charge. In order to prevent this, Japanese Laid-Open Patent Application No. 67105/1985 proposes that the sheets discharged from the image forming apparatus are counted using a sensor, and when the number becomes larger than the maximum staple number, the stapler does not operate, and instead, the image forming operation automatically stops after one set of originals is copied without continuing the further copying operation, irrespective of the number of copies preset to be taken. In this system, the unstapled copies are first to be taken out, in order to perform the second cycle. However, for the very reason that the image forming apparatus is equipped with the RDF feeder, the operator is usually leaves away from the image forming apparatus after setting the originals and depressing the copy button. Therefore, with the above proposal, much time is lossed by the discontinuance if a number of copies were to be copied.

A sheet finisher provided with a sheet folding mechanism and a stacker is also conventional, which is connected with and used with an image forming apparatus to receive a sheet from the image forming apparatus and to fold the sheet as desired into a predetermined form, and discharge it to the stacker. The sheet folding mechanism is usually operated in association with a document feeder of the image forming apparatus, so that when a sheet folding mode is selected by a folding mode selector, the original is fed from the automatic document feeder to a predetermined position of the image forming apparatus. The sheet on which an image of the original is formed is discharged from the image forming apparatus and is introduced into a relatively long conveying passage of the sheet folding means. The sheet finisher of this type stacks the sheet on the stacker at a fixed receiving position irrespective of whether the sheets are folded or not folded.

When the set of originals placed on the automatic document feeder contains mingled A3 size sheets and A4 size sheets, the recording sheets discharged from the image forming apparatus are of A3 size and A4 size in accordance with the sizes of the originals. However, both sheets are introduced into the folding passage, although the small size sheet (A4) is not to be folded. The folding passage is relatively long, with the result that the possibility of jam is higher and that wasteful electric power is consumed to unnecessarily operate various solenoids or other means for controlling the sheet transportation.

Also, if the sheet receiving position of the stacker is fixed irrespective of whether the sheets are folded or not, a problem arises, that is, if a great number of z-folded sheets are stacked, the z-folded portions constitute a thicker stack, and the subsequent sheet can go into the folded part of the already stacked sheet. In the case of two-folded sheets are stacked, this does not occur, but because of the larger thickness of the folded portions, the subsequent sheets can abut the already stacked sheets to disturb the alignment of the sheets or become a cause of jam.

Recently, some image forming apparatus is provided with a manual feeding means for allowing an operator to feed a copy sheet manually. This is provided in addition to determined size cassettes or a large capacity deck, to allow the operator to take copies in the size of post card or business card. When the apparatus is operated in the manual feed mode, the RDF feeder is usually not used, and instead, a book mode is selected wherein an original is placed on a platen glass by the operator.

If the image forming apparatus is provided with a means to discriminate the size of the sheet as in the case of using the cassette or deck, it is possible to staple the copies. However, usually, when the sheet is supplied manually, arbitrary sizes of sheets are supplied, it is difficult to discriminate the sizes of the sheets, and therefore, it is practically not possible to staple them. This is because when the sheets are to be stapled, it is required that the sheets are aligned in order, were which would not be possible if the sizes of the sheets were not known.

SUMMARY OF THE INVENTION

Accordingly, it is a principal object of the present invention to provide a small-size and high performance finisher.

According to an embodiment of the present invention, even if a number of originals beyond the maximum staplable number are set on the automatic document feeder, the image forming operation can be prosecuted to the end without occurrence of staple jam.

According to an embodiment of the present invention, sheet jam is prevented also in the sheet folding means and in a stacker.

According to an embodiment of the present invention, when the sheet is discharged from an image forming apparatus to a stapler in accordance with original feed by the automatic document feeder, and when the number of originals placed on the automatic document feeder is larger than the maximum stapling number, the sheet discharge is switched from an intermediate tray leading to the stapler to a stacker. The switching is performed automatically. Thus, the staple jam attributable to the overcharge is prevented.

According to this embodiment, the apparatus is not automatically stopped even when it is discriminated that the stapler is overcharged. Therefore, even if the operator is away from the apparatus after the start of the copying operation, the required number of copies are taken, thus avoiding the loss of time.

According to an embodiment of the present invention, if some error occurs in the stapler, the apparatus is not automatically stopped, so that even if the operator is away from the apparatus, the copying operation continues until the preset number of copies are taken, whereby the loss of time can be saved.

It is another object of the present invention to provide a sheet finisher which is prevented from stapling plural same copies together.

It is a further object of the present invention to provide a sheet finisher wherein the bundles of sheets to be stapled are aligned with high precision.

It is a further object of the present invention to provide a finisher wherein various sizes of copy sheets are aligned with high precision to allow them to be stapled in good order.

It is a further object of the present invention to provide a finisher wherein a great number of folded sheets can be stacked just as the unfolded sheets.

According to an embodiment of the present invention, when the sheets are to be folded by sheet folding means, the sheets which need to be folded are automatically discriminated, and those sheets are prevented from passing through the sheet folding means, whereby the sheet folding means is prevented from unnecessary operation to save energy. Simultaneously, the reliability in operation of the sheet folding apparatus is enhanced, and further, the occurrence rate of the sheet jam is reduced.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 4A and 4B are sectional views illustrating sheet folding actions in a two-folding mode, wherein FIG. 4A shows the state wherein a loop is formed in the middle of the sheet, and FIG. 4B shows the state wherein the sheet is two-folded at the center.

FIGS. 5A–5C illustrate various sheet folding modes, wherein FIG. 5A shows a two-folding mode, FIG. 5B shows a z-folding mode and FIG. 5C shows a reversed z-folding mode.

DESCRIPTION OF THE PREFERRED EMBODIMENTS

Figure 1:
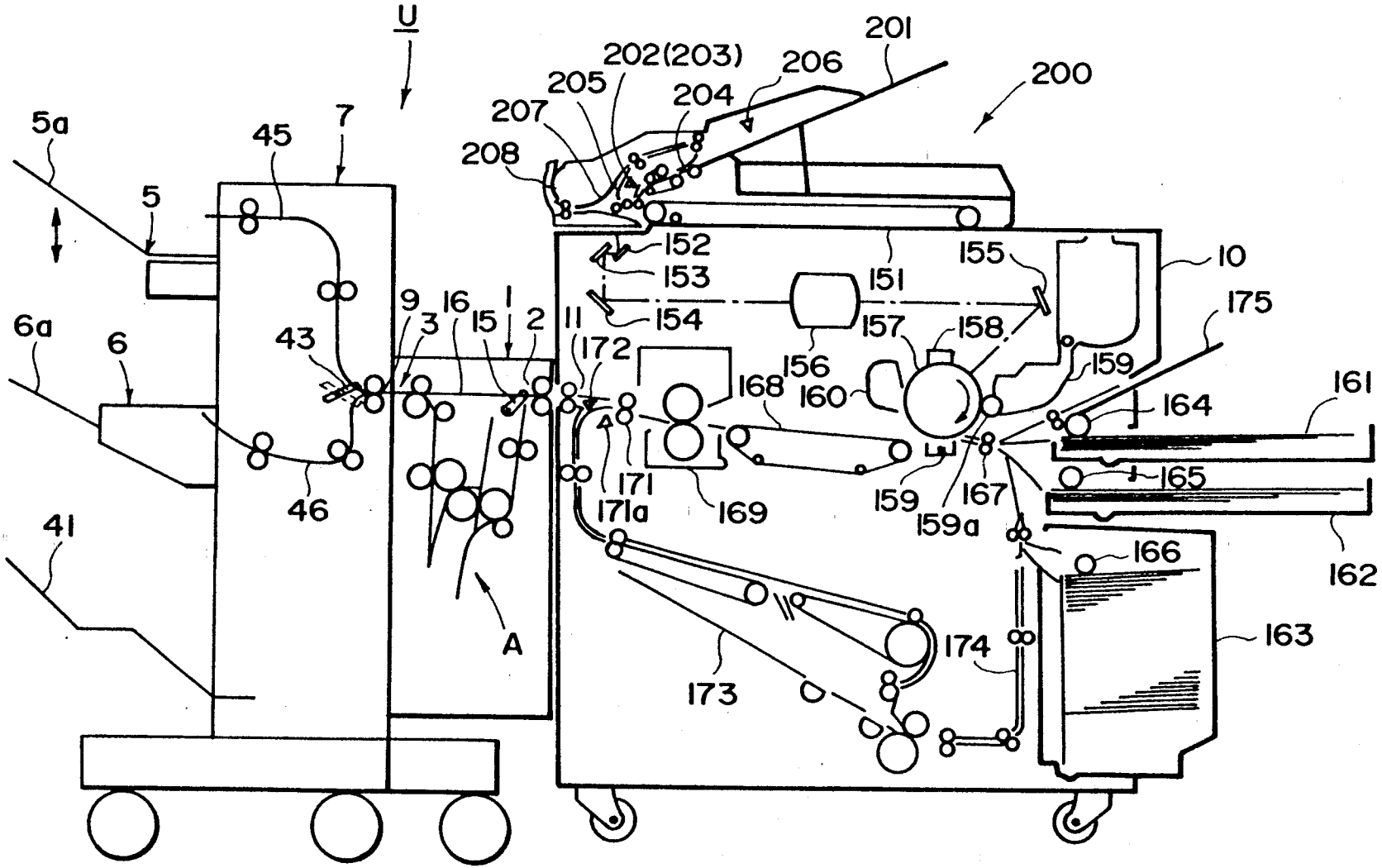
FIG. 1 is a sectional view of a sheet finisher according to an embodiment of the present invention, connected to an image forming apparatus which is used therewith.

Referring to FIG. 1, there is shown a sheet finisher U according to an embodiment of the present invention, which is used with an image forming apparatus, more particularly, a copying machine in this embodiment. The sheet finisher U comprises a sheet folding device 1 and a finisher device 7, wherein they are joined so that the sheet discharge outlet 3 of the folding device 1 is in alignment with the sheet inlet 9 of the finisher device 7. The sheet finisher unit U is joined with copying apparatus (image forming apparatus) 10 equipped with an automatic original recirculation type document feeder (RDF) 200 in the manner that the sheet inlet 2 of the folding device 1 thereof is in alignment with a sheet discharge outlet 11 of the copying machine 10. By those apparatuses combined in this manner, the copy or recording sheet which will hereinafter be called "sheet" P discharged from the copying machine 10 can be folded by the folding device 1 into a predetermined shape, and is stacked on a stacker 5 of the finisher device 7 or on a stapler 6 to be stapled.

The copying machine 10 includes a platen glass 151 for supporting an original to be copied, scanning mirrors 152, 153, 154 and 155 for scanning the original on the platen glass and deflecting the light reflected by the original, a lens 156 having a focusing and magnification changing functions. The copying machine 10 further comprises a photosensitive drum 57, a high voltage unit 158, a developing device 159, a transfer charger 159 and a cleaning device 160.

For the sheet handling, the copying machine 10 further comprises a lower cassette 162, a sheet feeding deck 163, pickup rollers 164, 164 and 166 and a registration roller 167. It further comprises an image fixing device 169, a conveyor belt 168 for conveying a sheet having an image to the fixing device 169, a conveying roller 171 and a sheet sensor 171*a*.

It includes a deflector 172 for selectively introducing a sheet to a discharge roller 11 or to a reversing tray unit 173. A manual sheet feeding tray 175 is provided to allow an operator to feed manually a recording sheet.

In response to actuation of a copy start key which will be described, the photosensitive drum 175 starts to rotate. Then, the drum 157 is subjected to a predetermined rotation control and a potential control. Then, an original placed on the platen glass is illuminated by an illumination lamp, and the light reflected by the original is directed by way of the scanning mirrors 152, 153, 154 and 155 and through the lens 156 onto a surface of the photosensitive drum 157 where an image is formed. Before the photosensitive drum 157 is exposed to the light image, it has been corona-charged with the aid of the high voltage unit 58. Thereafter, the photosensitive drum 157 is exposed to the light image, so that an electrostatic latent image is formed on the photosensitive drum 157.

The electrostatic latent image thus formed on the photosensitive drum 157 is developed by a developing roller 159*a* of the developing device 159 so that a visualized image is formed with toner, and the toner image is transferred onto a transfer sheet by the transfer charger 159.

On the other hand, the transfer sheet is discharged from the upper cassette 161, the lower cassette 162 or the deck 163 by the pickup roller 164, 165 or 166. The sheet is once stopped by the registration roller 167 so that a loop of the sheet is formed. The registration roller 167 refeeds the once stopped sheet in such a timed relation that the leading edge of the sheet is brought into alignment with the leading edge of the image formed on the photosensitive drum 157 which is rotating. When the sheet passes through between the photosensitive drum 157 and the transfer charger 159, the toner image on the photosensitive drum 157 is transferred onto the sheet. After the image transfer, the sheet is separated from the photosensitive drum 157 and is directed by the conveying belt 168 to the image fixing device 169 where the image is fixed by pressure and heat thereon. Then, the sheet is discharged by the conveying roller 171 and the discharge roller 11. If the sheet is not detected by the sheet sensor 171*a* at the predetermined timing, it is deemed that jam has occurred to require the operator to clear the jam.

When plural image forming operations are to be effected on the same sheet, a duplex mode or superimposing mode is inputted in the operation panel 175 of the copying machine. Then, the sheet is introduced by the deflector 172 to the reversing tray unit 173 and is fed to the photosensitive drum 157 again through the conveying passage 174.

The photosensitive drum 157 surface, after the image has been transferred, is brought to the cleaning device 160 where the surface of the photosensitive drum 157 is cleaned to be prepared for the next image forming operation.

The RDF feeder 200 includes a stacking tray 201 for stacking originals to be copied and sensors 202 and 203 for sensing sizes of the originals. The size sensors are disposed with a predetermined distance along a line perpendicular to the sheet of the drawing. The width of the original is detected depending on whether both sensors 202 and 203 detect the original or only one sensor 203 (disposed at rear side) detects the original. If the number of sensors is increased, a larger number of sizes can be discriminated. The length of the original is detected by the time period during which the sensor 202 or 203 detects the original, since it represents the time period required for the sheet to pass by the sensors.

The original fed to the platen glass 151 through the sheet passage 204 from the stacking tray 201 is returned through the sheet passage 205 to the stacking tray 201 where it is stacked again.

Where both sides of the original are to be copied, the original is once conveyed to the original supporting platen 105, and is then conveyed to the sheet passage 205 without being subjected to the image forming operation on the platen 105, and is stopped halfway in the sheet passage 205, and then is reversely transported. Thereafter, it is transported to the sheet passages 207 and 208 by an unshown deflector. The original is stopped in the sheet passage 208 and is reversely conveyed (switch-back), and the second side of the original is first subjected to the image formation on the original supporting platen 151. Then, it is fed to the sheet passage 205 again, and is reversed halfway of the sheet passage 205, then is transported to the sheet passages 207 and 208 by a deflector. The original is then switched back to be transported to the original supporting platen 151. Now, the first side of the original is subjected to the image forming operation, and thereafter, it is conveyed through the sheet passage 205 and is discharged onto the stacking tray 201, where it is stacked. In this embodiment, when both sides are to be copied, a duplex mode is selected in an operation panel 175 of the apparatus 10.

A sensor 305 is provided to detect completion of one cycle of the original circulation and produce a detection signal when the originals stacked on the stacking tray 201 are sequentially fed and all have been subjected to the image forming operation.

Figure 3:
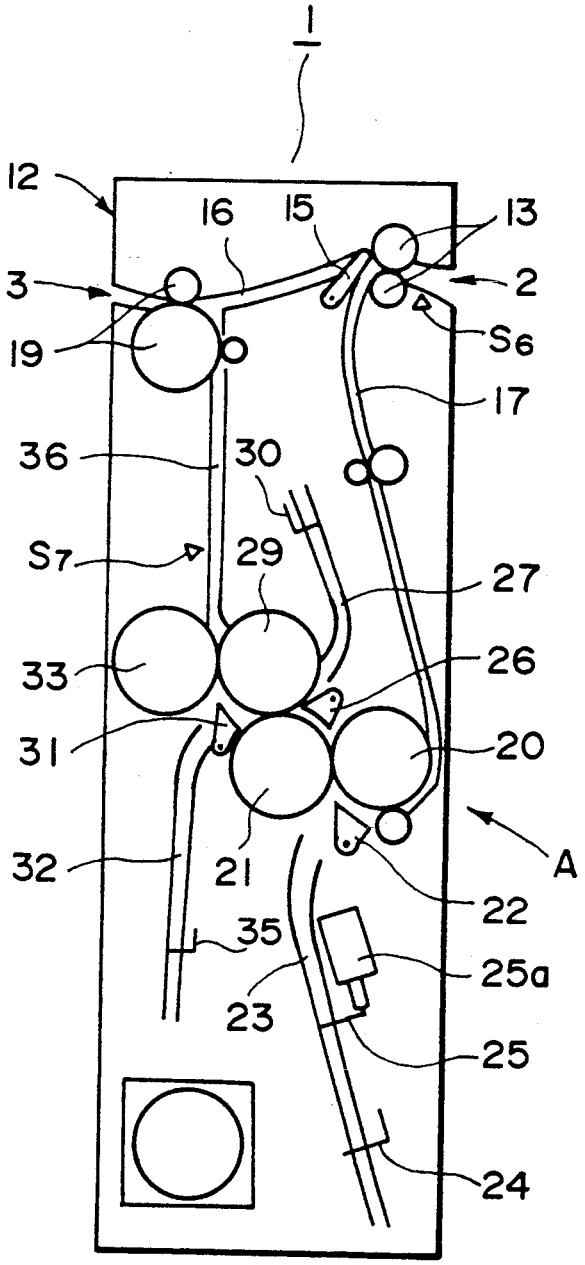
FIG. 3 is a sectional view of a sheet folder of a sheet finisher.

As shown in FIG. 3, the folding device 1 is provided with a couple of inlet rollers 13 in the sheet inlet 2 disposed at an upper position of the main body 12 of the sheet folding device 1. Downstream of the inlet roller couple 13 with respect to the movement direction of the sheet, there is an inlet deflector 15 disposed to selectively deflect the sheet in one direction or another, more particularly selectively to a through passage 16 or to a folding passage 17. At a downstream end of the through passage 16, there is a couple of discharging rollers 19, and downstream of the discharging roller couple 19, there is a sheet discharge outlet 3. The sheet discharge outlet 3 is disposed at substantially the same vertical level as that of the sheet inlet 2. Downstream of the sheet folding passage 17, there are various members constituting folding means A, which comprises a first folding roller 20, in the neighborhood of which a second folding roller 21 is disposed. Further, downstream of the first folding roller 20, there is disposed a first deflector 22 for selectively introducing the sheet P, conveyed from the folding passage 17, selectively to the first folding passage 23 or to a nip formed between the first folding roller 20 and the second folding roller 21. Downstream of the first folding passage 23, there are a first stopper 24 which is stationary and a movable stopper 25 which is actuatable by a solenoid 25*a* to project into the first folding passage 23. Downstream of the first folding roller 20 and the second folding roller 21, a second deflector 26 is disposed to introduce the sheet selectively to the second folding passage 27 or to a nip formed between the second folding roller 21 and a third folding roller 29 adjacent to the second folding roller 21. Downstream of the second folding passage 27, there is a second stationary stopper 30. Downstream of the second and third folding rollers 21 and 29, there are a third deflector 31 to introduce the sheet P selectively to a third folding passage 32 or to a nip formed between the third folding roller 29 and a fourth folding roller 33 adjacent to the third folding roller 29. Downstream of the third folding passage 32, there is a third stationary stopper 35. Downstream of the third and fourth folding rollers 29 and 33, there is an outlet passage for conveying the folded sheet, and downstream of the conveying passage 36 is merged with the conveying passage 16, and then communicates with the sheet discharge outlet 3.

Figure 6:
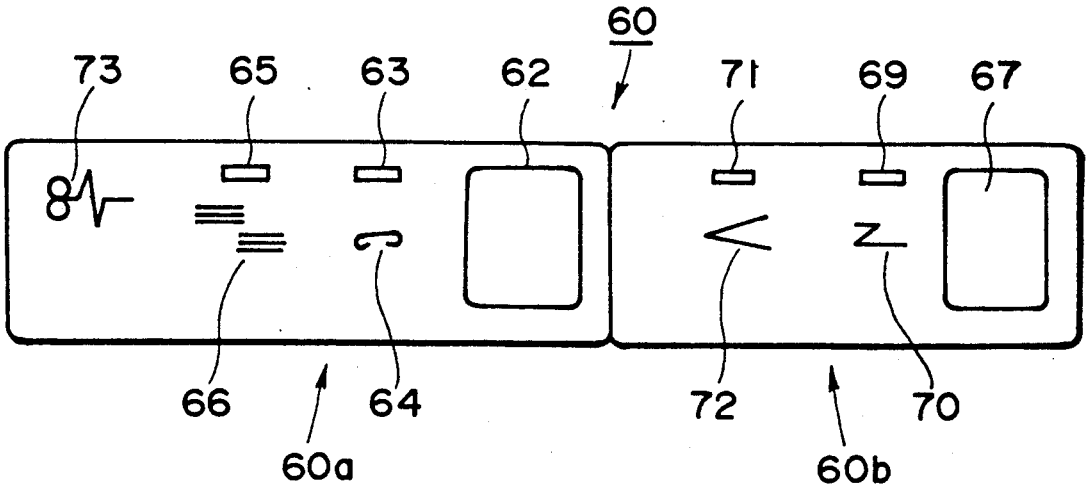
FIG. 6 is a top plan view of the finisher apparatus and the folding apparatus.

Referring to FIG. 6, there is shown an operating panel 60 of the finisher device 7 and the folding device 1, wherein reference 60*a* designates an operation panel of the finisher device 7, and reference 60*b* that of the folding device 1. The operation panel 60*a* includes a mode selector switch of the finisher device 7, by which a stacking mode or stapling mode can be selected. The panel further includes displays 63 and 65 including a light emitting diode (LED) or lamp for displaying the mode selected by the switch 62. The display 65 displays a picture 66 representing the stacking mode. The display 63 indicates the stapling mode together with a picture 64 representing this mode.

A mode selector switch 67 is provided in the operation panel 60*b* of the folding device 1, by which two-folding mode or z-folding mode can be selected. Displays 69 and 71 are effective to display the mode selected by the selector switch 67 by an LED or a lamp. The display 71 displays the two-folding mode together with picture 72 representing this mode. The display 69 displays the z-folding mode together with a picture display 70 illustrating this mode. Designated by a reference numeral 73 is a jam display for indicating occurrence of jam in the folding device 1 and the finisher device 7.

The folding device 1 is operable selectively in one of five modes, in accordance with mode selection on the operation panel 60 and mode section between two-folding mode and z-folding mode and in accordance with detection signals from the original size detecting sensors 202 and 203 or a sheet size sensor 161*a* and 162*a* for detecting the sizes of the sides in the cassettes.

The first mode is a through pass mode, which is executed when neither the two-folding mode or the z-folding mode is selected on the operation panel 60, and in this mode, the sheet is passed simply through the folding device 1. More particularly, the sheet P introduced from the sheet inlet 2 as shown in FIG. 3, is directed to a through passage 16 by the inlet roller couple 13 and the inlet deflector 15, and then is discharged to the finisher device 7 through the sheet discharge outlet 3 by the discharging roller couple 19.

The second mode is executed when either the two-folding mode or the z-folding mode is selected on the operation panel 60, and when half size sheets, i.e., A4 or B5 or smaller sheets are used. In this mode, the sheet P introduced to the inlet deflector 15 by the inlet roller couple 13 is directed to the sheet folding passage 17, and is discharged through the sheet discharging outlet 3 by the discharging roller couple 19 after being passed between the first and second folding rollers 20 and 21, between the second and third folding rollers 21 and 29 and between the third and fourth folding rollers 29 and 33 and passing through the outlet passage 36, by the first, second and third deflectors 22, 26 and 31.

Whether the sheet is of the half size or not is discriminated by signals from the sheet size sensor 161*a*, 162*a* for detecting the sizes of the sheet contained in the cassette 161 and 162.

Figure 4A:
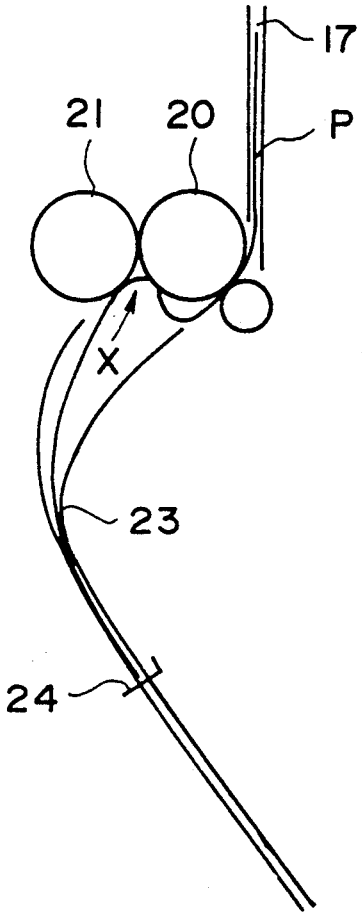
Figure 4B:
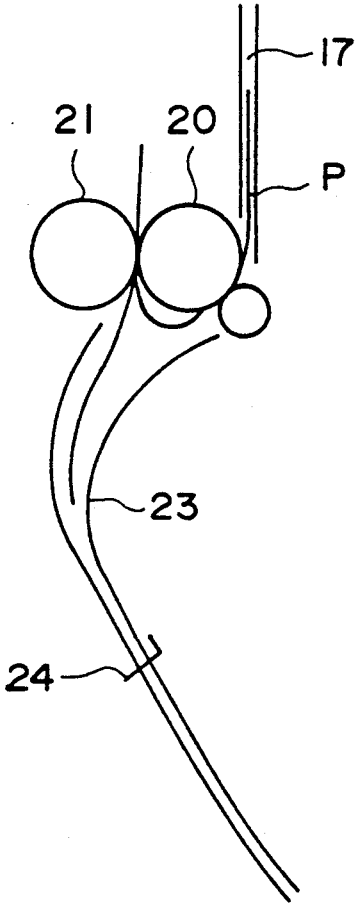
Figure 5A:
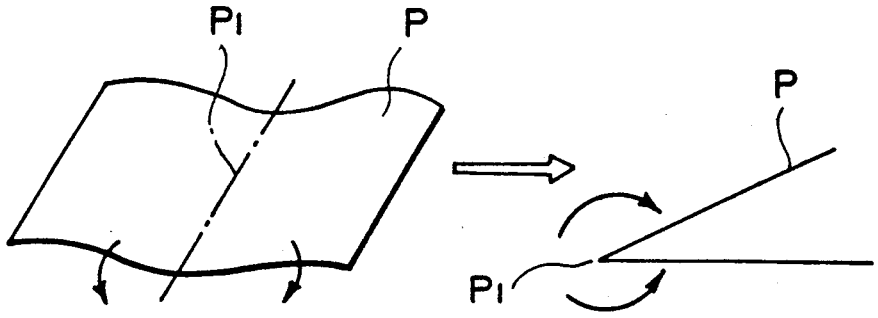

The third mode is a two-folding mode, which can be selected on the operation panel 60. In this mode, A3, B4 or larger sheets are two-folded. The sheet P introduced from the inlet roller couple 13 to the sheet folding passage 17 by the inlet deflector 15 is directed to the first folding passage 23 by the operation of the first deflector 22. As shown in FIG. 4A, when the leading edge of the sheet P is abutted to the first stationary stopper 24, a loop X is formed in the middle of the sheet P. When the loop X is expanded, as shown in FIG. 4B, the loop is caught by the nip formed between the first folding roller 20 and the second folding roller 21, so that the sheet P is folded to form a crease Pl at the center of the sheet (FIG. 5A). The folded sheet P is introduced into between the second and third folding rollers 29 by the second deflector 26 and the third deflector 31. It is further conveyed between the third folding roller 29 and the fourth folding roller 33, and is discharged by the discharging roller couple 19 through the outlet passage 36.

Figure 5B:
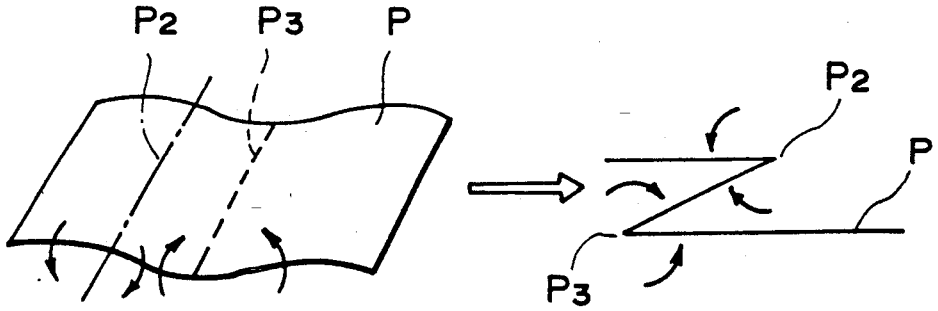

The fourth mode is a z-folding mode, wherein the sheet is first two-folded, and thereafter one side of the two-folded sheet is folded back. In this mode, the sheet P introduced from the inlet roller couple 13 to the sheet folding passage 17 by the inlet deflector 15 is first introduced into the first folding passage 23 by the first deflector. When the leading edge of the sheet P is abutted to a movable stopper 25 which has been projected thereinto by the solenoid 25*a*, a loop is formed at a portion which is ¼ away from the leading edge of the sheet P. The loop is gripped by the nip formed between the first and second folding rollers 20 and 21, so that a first crease or fold P2 is formed on the sheet P (FIG. 5B). Then, the thus folded sheet P is introduced to the second passage 27 by the second deflector 26. When the first crease P2 thereof abuts the second stationary stopper 30, a loop is similarly formed at a portion further about ¼ away from the first crease P2 of the two-folded sheet P, and the loop is caught by the nip formed between the second and third folding rollers 21 and 29, so that a second fold or crease P3 is formed (FIG. 5B). The z-folded sheet which has been further folded to the front side is introduced into between the third and fourth roller couples 29 and 33 by the third deflector 31, and .uj0 is discharged to the finisher device 7 by the discharging roller 19 through the outlet passage 36.

In the folding device 1, there is a selection switch for making selection between a regular z-folding mode described above and a reversed z-folding mode (FIG. 7, 67*a*).

The fifth mode is the reversed z-folding mode. This mode is executed when the z-folding mode is selected on the operation panel 60, and the reverse z-folding mode is selected by the selector switch 67*a*. In this mode, similarly to the above case, the sheet P introduced by the inlet roller couple 13 to the sheet folding passage 17 by the inlet deflector 15 is directed to between the first and second folding rollers 20 and 21 by the first deflector 22 and further to the second folding passage 27 by the second deflector. However, when the leading edge of the sheet P is abutted to the second stationary stopper 30, a loop is formed at a portion about ¼ away from the leading edge of the sheet P and is caught by the nip formed between the second and third folding rollers 21 and 29, so that as shown in FIG. 5C, a first crease P4 is formed.

Figure 5C:
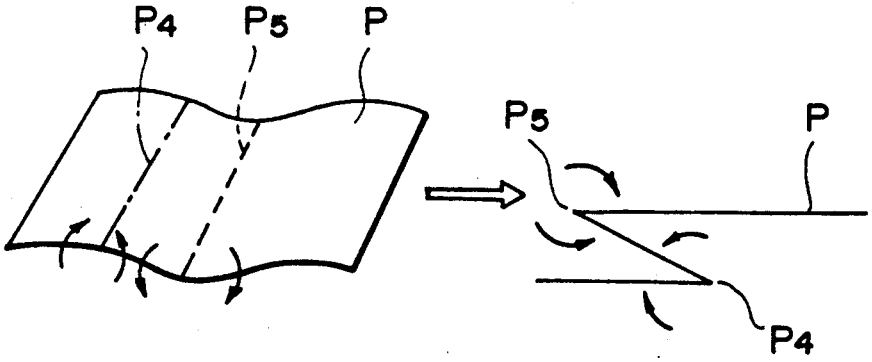

Thereafter, the sheet P is introduced into the third folding passage 32 by the third deflector, when the crease P4 of the sheet P is abutted to the third stationary stopper 35, by which a loop is formed at a portion further about ¼ away from the crease P4 of the sheet P, and the loop is gripped by the nip formed between the third and fourth folding rollers 29 and 33, so that as shown in FIG. 5C, a second fold or crease P5 is formed.

The reverse z-folded sheet P which has been folded reversely is discharged by the discharging roller couple 19 through the outlet passage 36.

Referring back to FIG. 3, there are provided an inlet sensor S6, a folded sheet detecting sensor S7 for measuring the length of the folded sheet P.

Further referring back to FIG. 2, the finisher device 7 is provided at a rear upper position of the main body of the finisher device 7 with a stacker station 5 including a stacker 5*a*, the stacker station 5 being vertically and horizontally reciprocable by driving means such as motor or the like. The stacker station 5 is further provided at a lower position with an intermediate tray 6*a* for a stapler 6. To the bottom end of the intermediate tray 6*a*, a stopper 40 is rotatably mounted and is effective to stop an end of the sheet P on the tray 6*a*. Below the stapler station 6, there is a lower tray 41, on which the sheets P on the intermediate tray 6*a* is fallen by the rotation of the stopper 40, and the fallen sheets are accommodated on the lower tray 41. A sheet inlet 9 is disposed at front upper portion of the main body 39 of the finisher device, and is so disposed as to be at substantially the same level as the sheet discharging outlet 11 of the copying machine 10. In the sheet inlet 9, an inlet roller couple 42 is disposed, and downstream of the inlet roller couple 42, an inlet deflector 43 actuatable by a solenoid 95 (driving means) to direct the sheet P from the sheet inlet 9 selectively to a passage 45 leading to the stacker station 5 or to a passage 46 leading to the stapler station 6. Downstream of the stacker passage 45, there is a discharging roller couple 47 to discharge the coming sheet P to the stacker 5*a*. Adjacent the downstream end of the stapler passage 46, there is disposed a stapler portion discharging roller couple 49. Around the lower one 49*a* of the discharging roller couple 49, a part of a belt 50 is abutted, the belt 50 having a lower end portion in contact with the intermediate tray 5*a*. The belt 50 is rotated together with the lower roller 49*a* to align the sheet P discharged onto the intermediate tray 6*a* in the longitudinal direction (discharging direction) along the stopper 40 at their trailing edges. The lateral alignment of the sheets P are performed using a stepping motor PM. A stapler 51 is disposed above the bottom end of the intermediate tray 6*a*, and it functions to staple the sheets P discharged onto the intermediate tray 6*a*.

When the staple mode is selected, the sheet P introduced from the sheet inlet 9 by the receiving roller couple 42, is directed to the stapler passage 46 by the inlet deflector 43, and is once discharged onto the intermediate tray 6*a*, by the stapler discharging roller couple 49 on which the sheets are aligned.

The sheets P aligned on the intermediate tray 6*a* are stapled adjacent one longitudinal end by the stapler 51. Thereafter, the stopper 40 rotates to allow the stapled sheets to fall on the lower tray 41. The stapled sheets are accommodated there.

The finisher device 7 is provided with various sensors including a finisher inlet sensor S1 disposed at the sheet inlet 9, a stacker outlet sensor for detecting the sheet P discharged onto the stacker station 5, a sensor S3 constituting an intermediate tray outlet counter for counting the number of sheets discharged onto the intermediate tray 6*a* of the stapler station 6. The sensor or counter S3 produces a signal to the solenoid 95 when the number of discharged sheet reaches a predetermined number of sheets which can be stapled by the stapler, and simultaneously therewith, the inlet deflector 43 is switched to the stacker passage 45. A sensor S4 is an intermediate tray sheet detecting sensor for detecting the sheet discharged onto the intermediate tray 6. A sensor S5 is a level detecting sensor disposed along the stacker 5*a*.

Figure 7A:
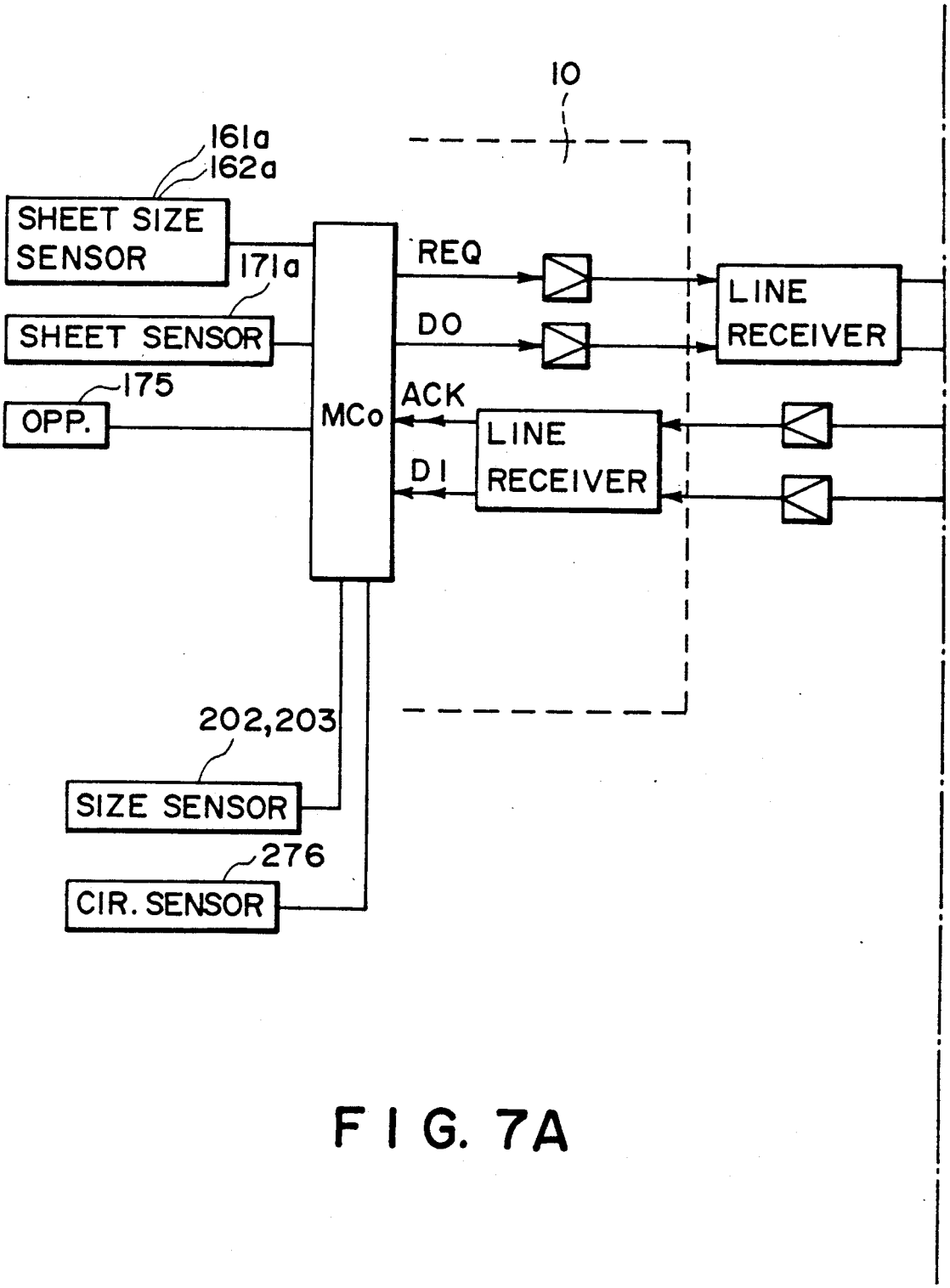
FIG. 7 is a block diagram illustrating a control of the sheet finisher according to this embodiment.
Figure 7B:
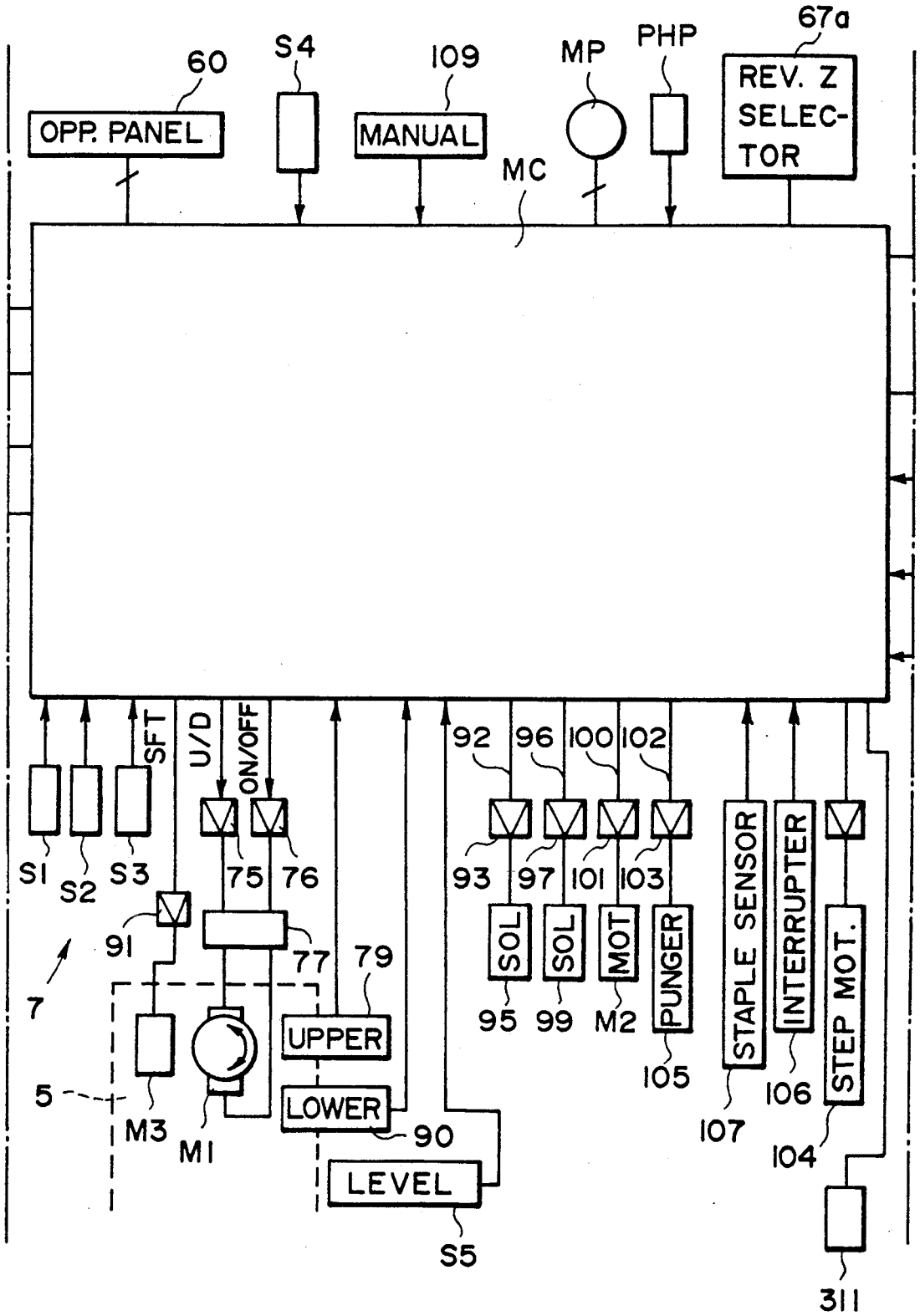
Figure 7C:
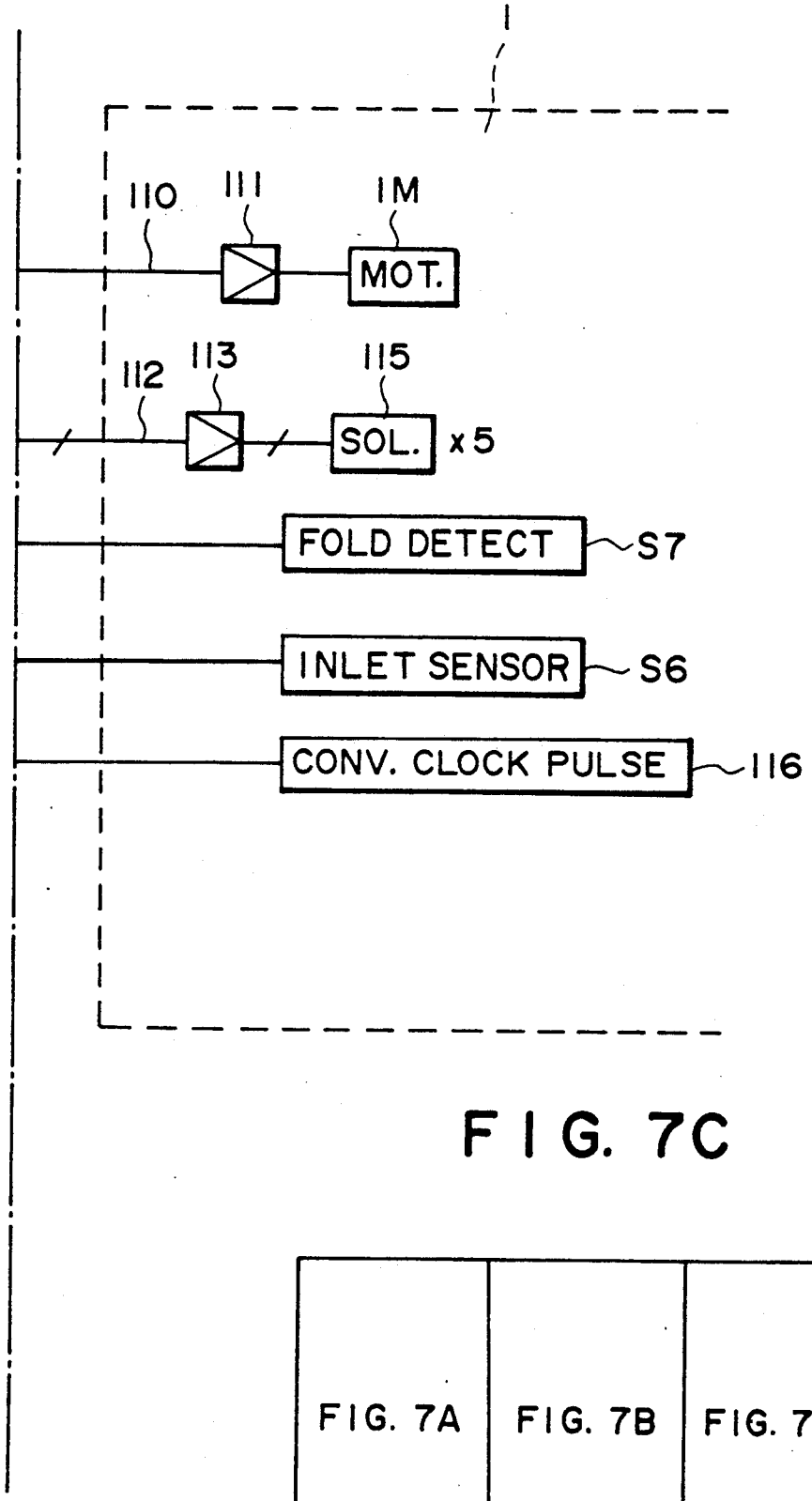
Figure 7:
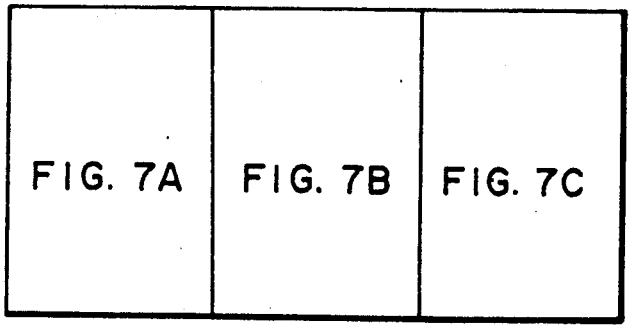

Referring to FIG. 7, an example of a control circuit for controlling the finisher unit U will be described. Between a microcomputer MC0 for controlling the copying machine 10 and a microcomputer MC for the finisher device 7, a serial communication of half-duplex asynchronous type is established, wherein in response to a communication requesting signal REQ from the copying machine 19, a communication allowing signal ACK is produced from the finisher device 7, then the communication proceeds transmitting DI in accordance with the data signal DO. The data signal DO transmitted from the copying machine 10 mainly contains intermediate state signal representing such as copy start, copy end, copy size, copy number and jam occurrence. The data signal DI transmitted from the finisher device 7 side indicates intermediate state such as completion of the set number, no stapling or jam occurrence. Designated by the reference 60 is the operation panel described in conjunction with FIG. 6. Designated by references S1, S2, S3 and S4 are the finisher inlet sensor, the stacker outlet sensor, intermediate tray outlet counter and the intermediate tray sheet detecting sensor, respectively. An up/down signal U/D and an ON/-OFF signal are transmitted to a control circuit 77 through buffers 75 and 75 to control the upward and downward movements and on-off of the stacker station 5. By this, a stacker motor Ml is controlled. The stacker station 5 is equipped with an upper limit sensor 79, a lower limit sensor 90 and a level detecting sensor S5. Those sensors are contributable to the control of the stacker motor M1. Further, in order to sort bundles of sheets, a motor M3 for shifting laterally the stacker station 5 is provided and is controlled by an SFT signal through a buffer 91.

A signal 92 is effective to control and operate the inlet deflector 43 provided at the inlet of the finisher device 7. In response to the signal 92, the solenoid 95 is energized through the buffer 93, and the sheet is selectively introduced to the stacker station 5 or to an intermediate tray 6*a*.

A signal 96 controls rotation of the stopper 40. In response to the signal 96, the solenoid 99 is driven through a buffer 97, and the stapled sheets are allowed to fall onto the lower tray 41.

A signal 100 drives the sheet conveying motor M2 through a buffer 101; a signal 102 drives a plunger 105 for the stapler through a buffer 103. Designated by a reference 106 is an interruptor for producing a pulse proportional to the number of rotations of the motor M2; 107 is a reflection sensor for detecting presence and/or absence of staples at the stapler 6; 109 is a manual switch for stapler to stapling in book mode or the like. A stepping motor PM functions to make lateral alignment of the sheets P discharged onto the intermediate tray 6a. A pulse motor home position sensor PHP serves to detect a reference position of the stepping motor PM. For the folding device 1, a signal 110 is effective to drive the sheet conveying motor Ml through a buffer 111, and further, in accordance with a mode signal 112 representing the selected folding mode, associated plural deflectors and stoppers are properly actuated, and through a buffer 113, selected one of the five deflectors and stopper solenoid 115 are properly actuated. The control system includes an interruptor 116 for producing a pulse proportional to the rotational speed of the sheet conveying motor IM.

Figure 8:
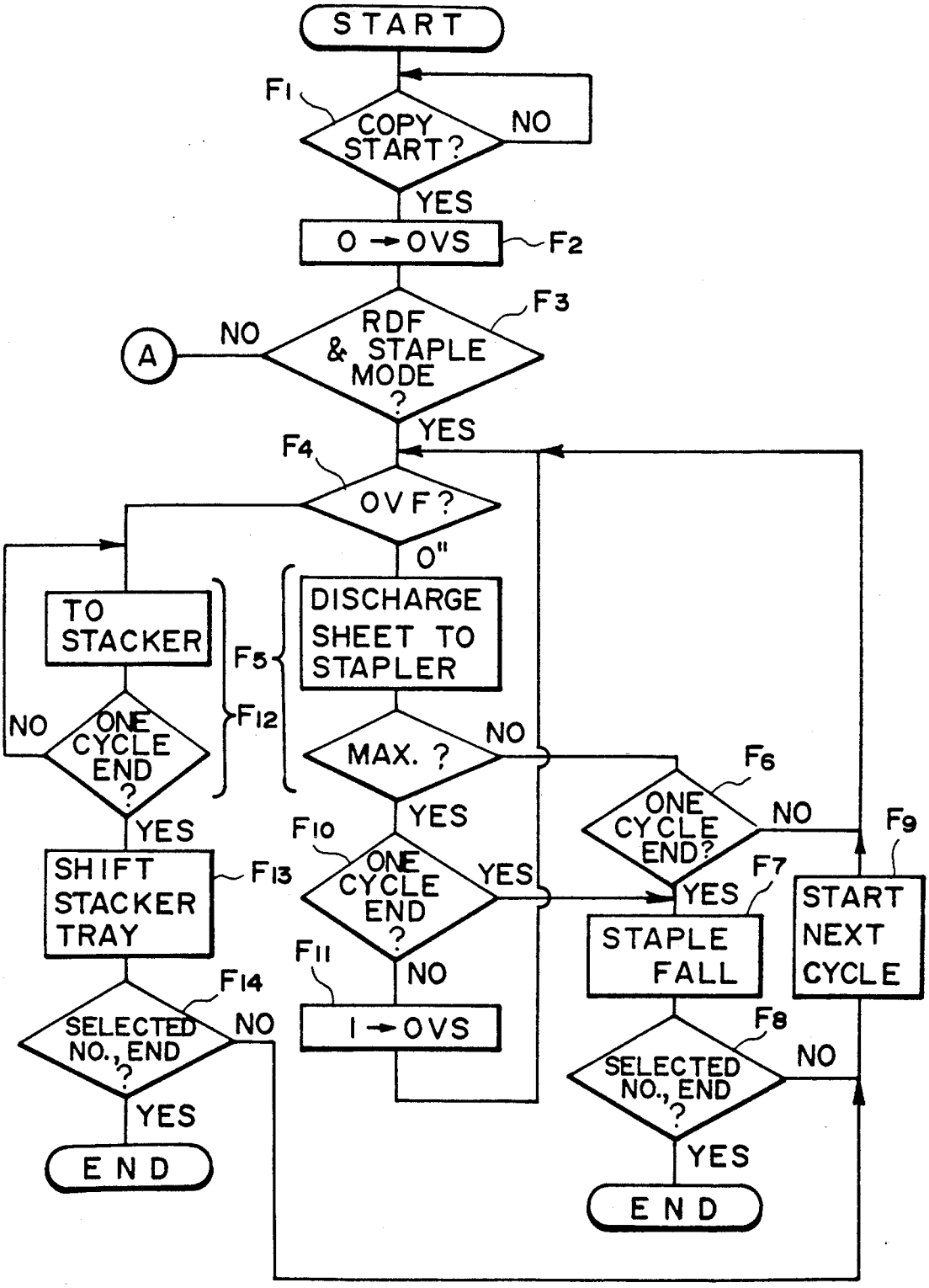
FIG. 8 is a flow chart illustrating the control operations.
Figure 9:
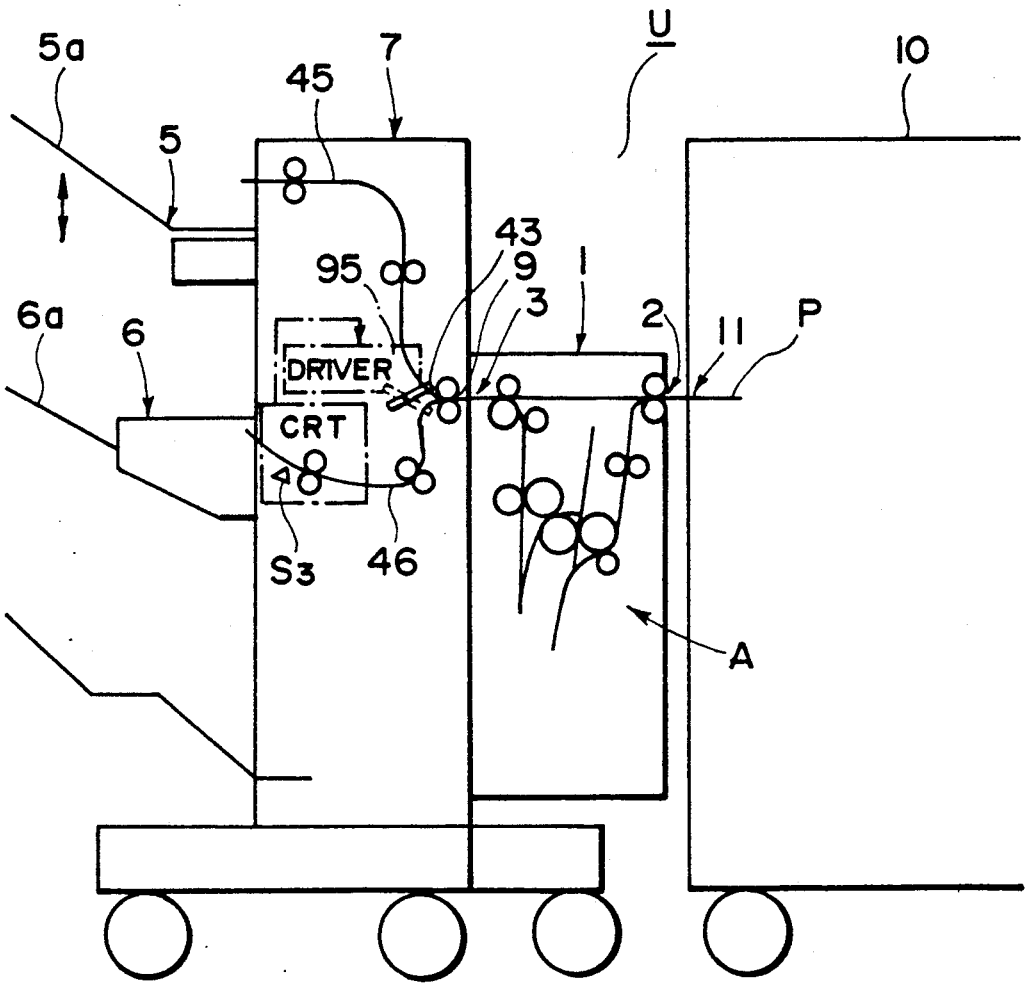
FIGS. 9 and 10 are block diagrams for the control when the stapler is overcharged according to this embodiment of the present invention.

Referring to FIGS. 8 and 9, the operation of the sheet finishing unit U according to this embodiment will be described.

When start of the copying operation of the copying machine 10 is detected at step Fl, the folding device 1 and the finisher device 7 are instantaneously is placed in operative conditions. At step F2, an overflow bit which will hereinafter be called "OVF" is initialized to zero. At the next step, F3, the discrimination is made as to whether or not the mode is the RDF using and stapling mode. If not, the sequence goes to the flow A, which however is not directly related to a feature of this present embodiment, and therefore, the description of which is omitted. At the start of the copying operation, OVF is 0, and therefore, the sequence goes to step F5 from the step S4, so that a sheet P is discharged to the stapler station 6. At this time, the intermediate outlet counter S3 counts the discharged sheet P, and the discrimination is made as to whether or not the count reaches the maximum staplable number N (normally about 30). If not, the description is made as to whether or not one cycle of the original circulation is effected by the RDF feeder. If not, the above-described operations are repeated to the step F4. When one cycle of the circulation is completed by the RDF feeder, the sheets are stapled at step F7, and the stapled sheets P are allowed to fall onto the lower tray 41. Thereafter, at step F8 it is discriminated whether or not the preset number of copies are reproduced. If not, the next copying operation is prepared at step F9, and the sequence goes back to the step F4, and the operations are repeated until the preset number of copies are reproduced.

Referring back to step F5, if the count reaches the maximum staplable number N, the intermediate tray outlet counter S3 produces a signal. At step F10, the discrimination is made as to whether or not the one cycle of the circulation is completed by the RDF feeder. If the one cycle is completed just at the step F10, the sequence goes to step F7, and the subsequent operations are the same as described before.

The number of the sheets discharged can be counted not by the outlet counter S3, but by counting the number of sheets passed by the sheet sensor 171a of the image forming apparatus 10. Alternatively, the number of the discharged sheets can be counted by counting the number of originals detected by the original size detecting sensors 202 and/or 203 together with detection of the original size. However, care could be taken to the case of duplex originals, from which simplex copies are reproduced, since then the number of originals has to be doubled to obtain the number of copy sheets discharged. Similarly, when duplex copies are to be reproduced from simplex originals, the number of discharged sheets is one half of the number of originals. Therefore, the microcomputer MC0 of the main apparatus or the microcomputer MC of the finisher device calculates correct number of copies sheets to be discharged on the basis of the number of originals.

At step F10, when one cycle of original circulation is not yet completed, the OVF is set to 1 at step F11, and the sequence goes back to the step F4. This means that the number of the originals stacked on the RDF feeder is beyond the maximum staplable number. At this time, the inlet deflector 43 is switched to the stacker side at step 12, the sheets P are continued to be discharged not to the stapler but to the stacker station 5 until the end of one cycle of the original circulation. When one cycle is completed, the stacker station 5 is shifted in a horizontal plane at step 13, so as to prepare or assist the sorting of the sheets discharged thereon.

At step F14, the copied number of sets are compared with the preset number, and if the preset number is larger, the sequence goes from the step F9 to step F12 through the step F4, and the sheets P are all discharged to the stacker station 5, and are shifted for each of the cycles. These are repeated until the present number of copies are produced.

In the foregoing description, the copying machine 10 used with the sheet finishing unit U is provided with an automatic document feeder of an automatic recirculation type. However, the present invention is not limited to this, but is applicable to an automatic document feeder whereby the originals are automatically fed to a predetermined reading position of the copying machine 10.

As an alternative, it is possible to discriminate prior to start of the copying operation whether or not the discharged sheets will be over the maximum staplable number, by circulating prior to the start of the copying operation the originals without image formation, by the RDF feeder, during which the number of originals is counted.

Figure 10:
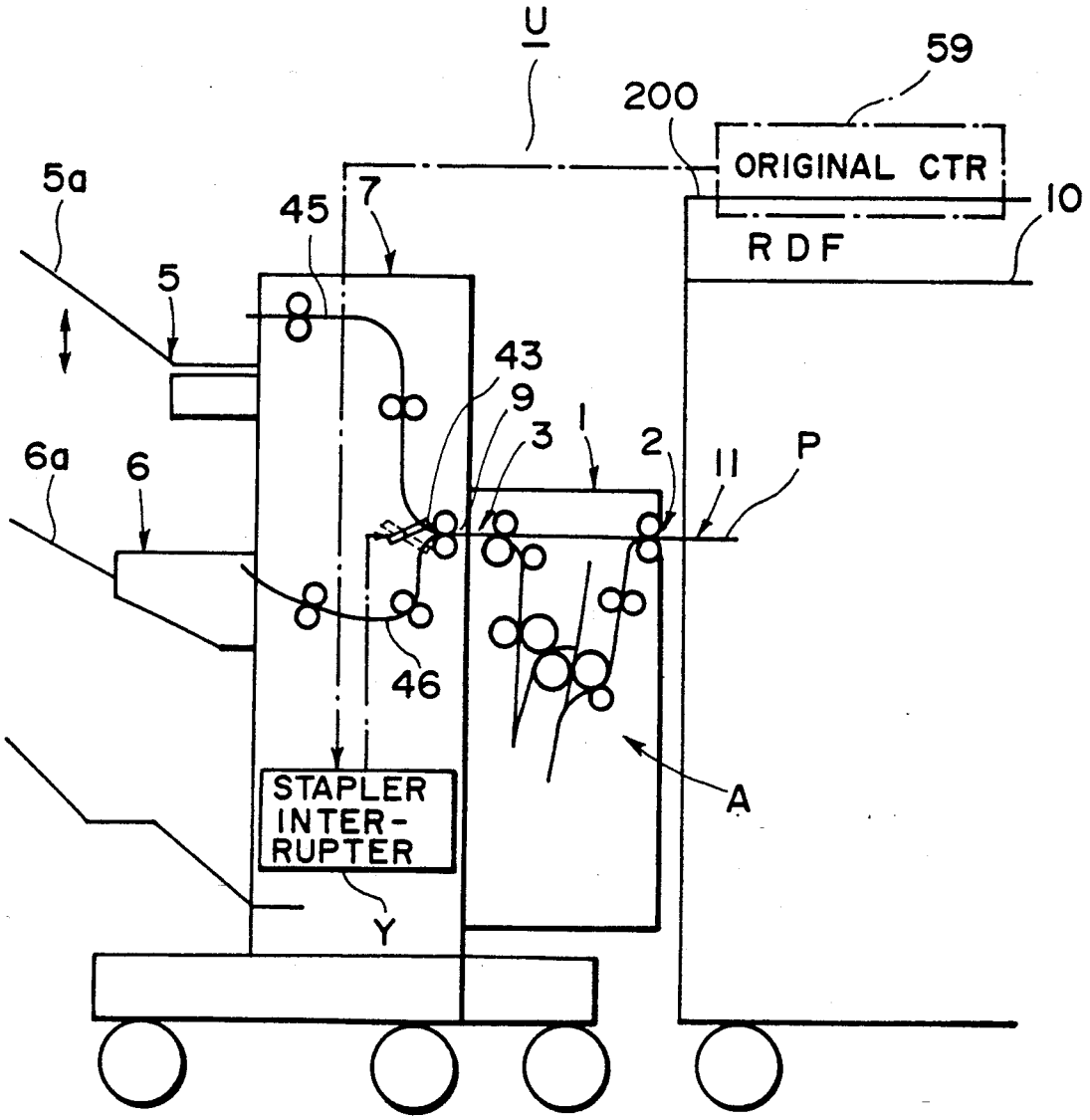

FIG. 10 shows this embodiment, wherein when the stapling mode is selected, the originals stacked on the RDF feeder 200 are fed one by one from the RDF feeder 200 to the image leading station of the copying machine 10, and then they are returned to be stacked again on the RDF feeder 200. During this circulation operation, the number of originals is counted by an original counter S9. The counter S9 produces an output when the count is over the predetermined maximum staplable number by the stapling station.

The sheet finisher unit U is provided with staple stopping means Y, which is responsive to the output signal of the original counter S9 to display, as desired, at the display 63 on the operation panel the exceeding of the number of originals on the RDF feeder 10' beyond the maximum staplable number, and/or prohibit copying operation of the copying machine 10, or to switch the conveyance of the sheet P to the stacker station 5.

Figure 11:
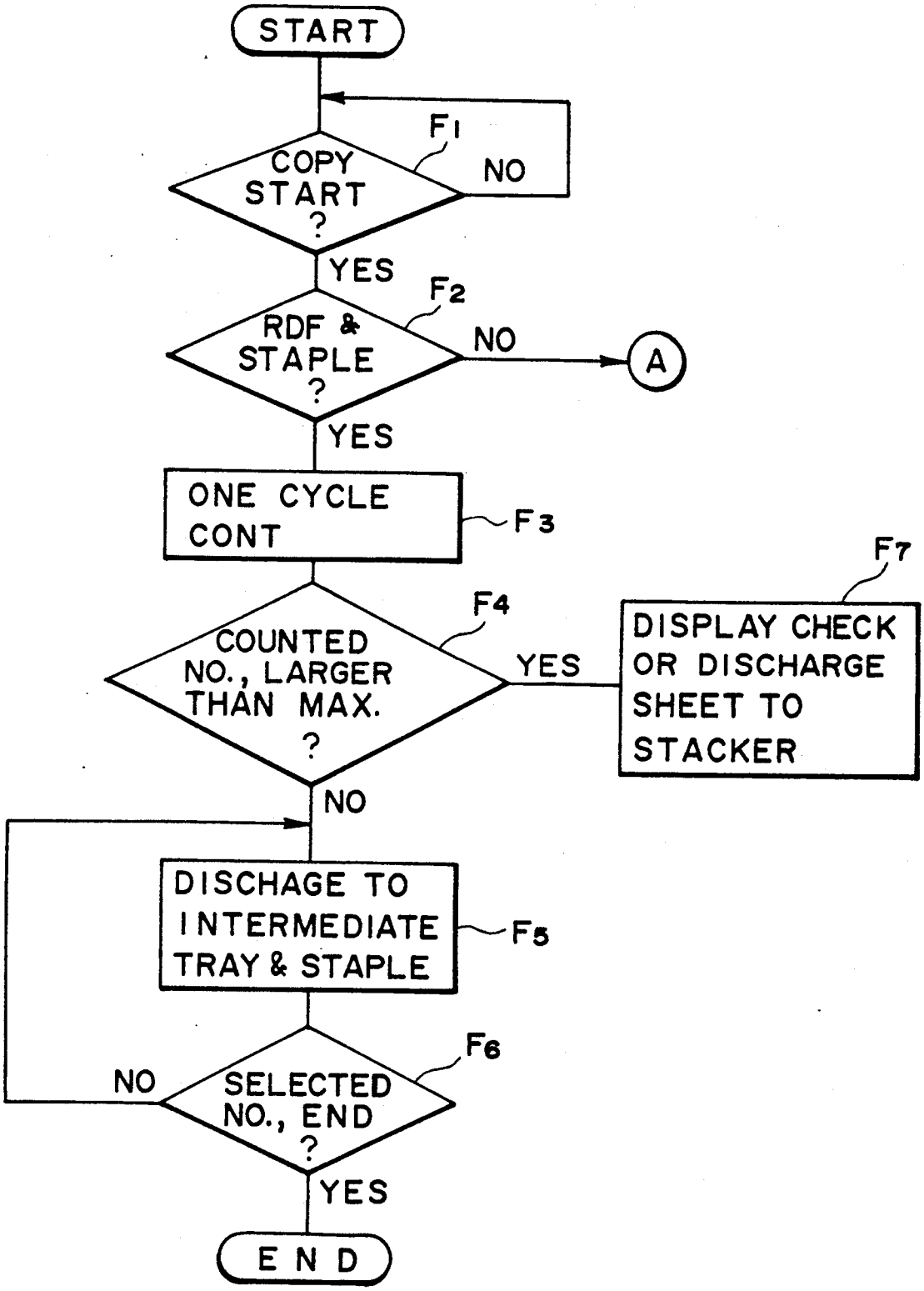
FIG. 11 is a flow chart illustrating the control system shown in FIGS. 9 and 10.

Referring to FIG. 11, the operation of the sheet finisher unit U of this embodiment will be described. At step Fl, when the start of the copying operation of the copying machine 10 is detected, the folding device 1 and the finisher device 7 are instantaneously placed under operative conditions. As step F2, the discrimination is made as to whether or not the mode is the RDF feeder using and stapling mode. If so, the sequence goes to step F3 where during the originals being circulating by the RDF feeder 200, the number of the originals stacked on the RDF feeder 200 is counted by the original counter S9. If, at this time, two-folding mode is set, one large size original is counted as two. If it is apparent at a glance by the operator that the number of the originals is larger than the maximum staplable number, the count cancelling switch, which may be provided for this purpose, is actuated to cancel the counting action. On the contrary, the switch may be such that it is actuated only when the counting is desired. If the result of the discrimination at step F2 is negative, the sequential flow branches to "A", which, however, is not directly related to the feature of the present embodiment, and therefore, description of which is omitted for the sake of simplicity.

Next, at step F4, the number of originals on the RDF feeder 200 counted by the original counter S9, is below the maximum staplable number, the sequence goes to step F5, where the sheet P is discharged to the intermediate tray 6*a* of the stapling station 6, on which the bundle of sheets is stapled. Further, at step F6, the discrimination is made as to whether or not the preset number of copies have been reproduced. If not, the sequence goes back to step F5. The above described operations are repeated until the preset number of copies are taken. At step F4, if the count of the originals is larger than the stapling capability, the sequence goes to step F7, where the display to the effect is lit on.

On this occasion, the copying operation may be prohibited, but instead, the deflector 43 may be switched to the stacker station 5 side, and then the copying operation is started, since the stacker station 5 is capable of stacking a large number of sheets P.

The original counter S9 is not necessarily provided independently on the RDF feeder 200, but the detection signals from the sensor 202 and/or 203 may be used in which case the microcomputer MC0 or MC calculates the number of sheets.

Next, the description will be made with respect to jam clearance when the staple is jammed.

Figure 12:
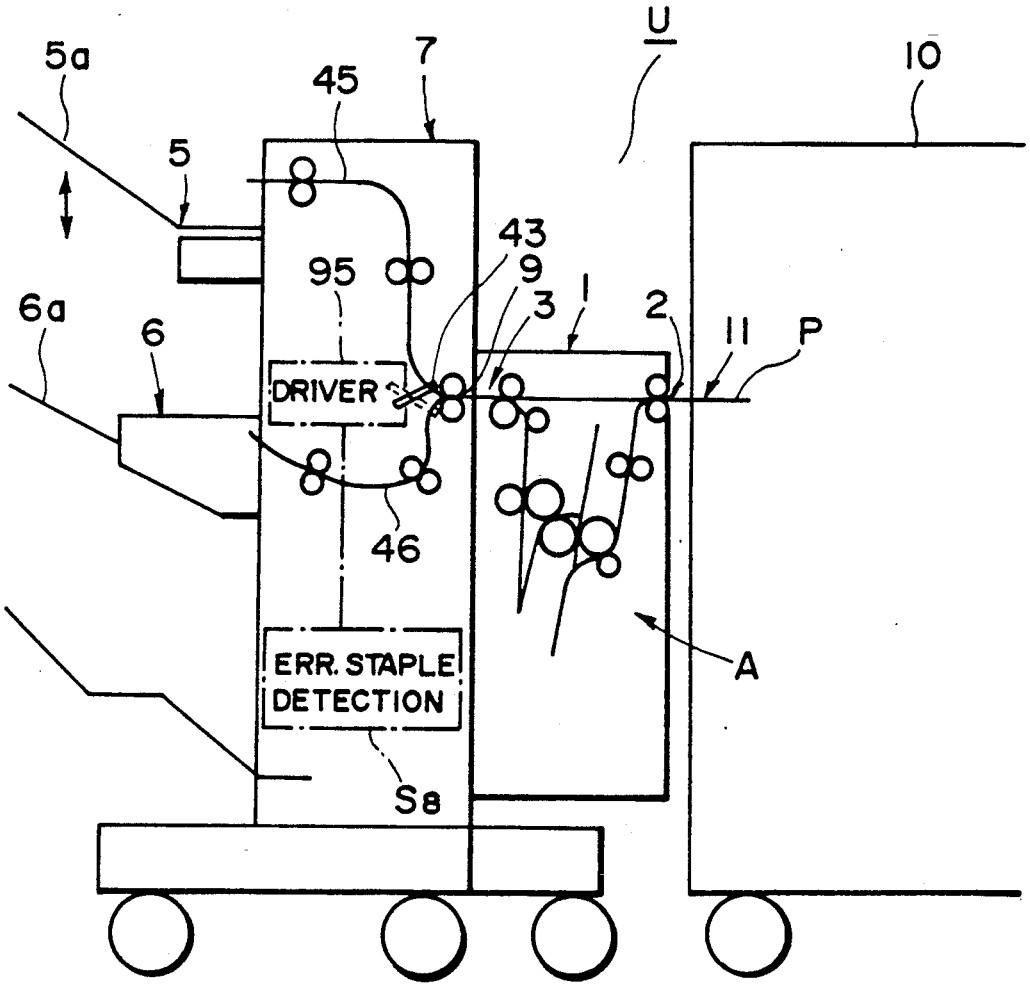
FIG. 12 is a block diagram illustrating a control when the stapler malfunctions.

Referring to FIG. 12, the finisher device 7 is provided with means S8 for detecting a malfunction of the stapler, particularly jam of the staple. The malfunction detecting means S8 detects the malfunction on the basis of the event that the driving source (generally a motor or plunger) for actuating the stapler does not operate at all or on the basis of the event that even if it is actuated, it does no return to its initial or home position within a predetermined period of time. An example of the stapler malfunction detection is disclosed in Japanese Laid-Open Patent Application No. 64802/1985.

Figure 13:
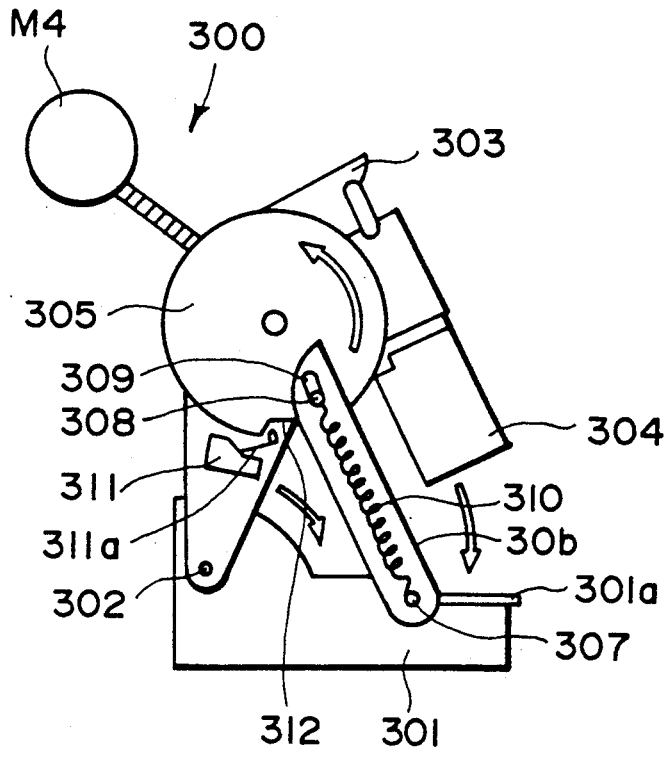
FIGS. 13 and 14 illustrate a structure of a stapler.

Referring to FIG. 13, there is shown a structure of the stapler 300. The stapler includes a base 301, a frame 303 rotatably mounted to the base 301 by a pin 302 and a main assembly of the stapler 304. The portion of the base 301 that is opposed to the main assembly 304 is formed into an anvil 301*a*. To the frame 303 a cam 305 is mounted which is rotatingly driven by a stapler motor M4. The base 301 and the cam 305 are joined by an arm 306, which is in turn rotatably mounted to the base 301 by a pin 307. The cam 305 and the arm 306 are connected by engagement of a pin 307 formed on the cam 305 into an elongated slot 309 formed in the arm 306. Between the pin 307 and the pin 308, a tension spring 310 is stretched. A home position sensor 311 functions to detect whether or not the main assembly 304 is at the home position, that is, the stand-by position. When the stapling assembly 304 is at the home position, the detecting arm 311*a* of the switch is engaged into a recess 312 of the cam 305 and produces a detection signal.

Figure 14:
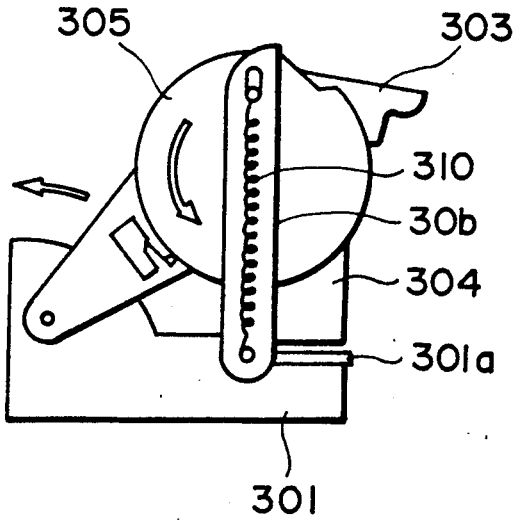
Figure 15:
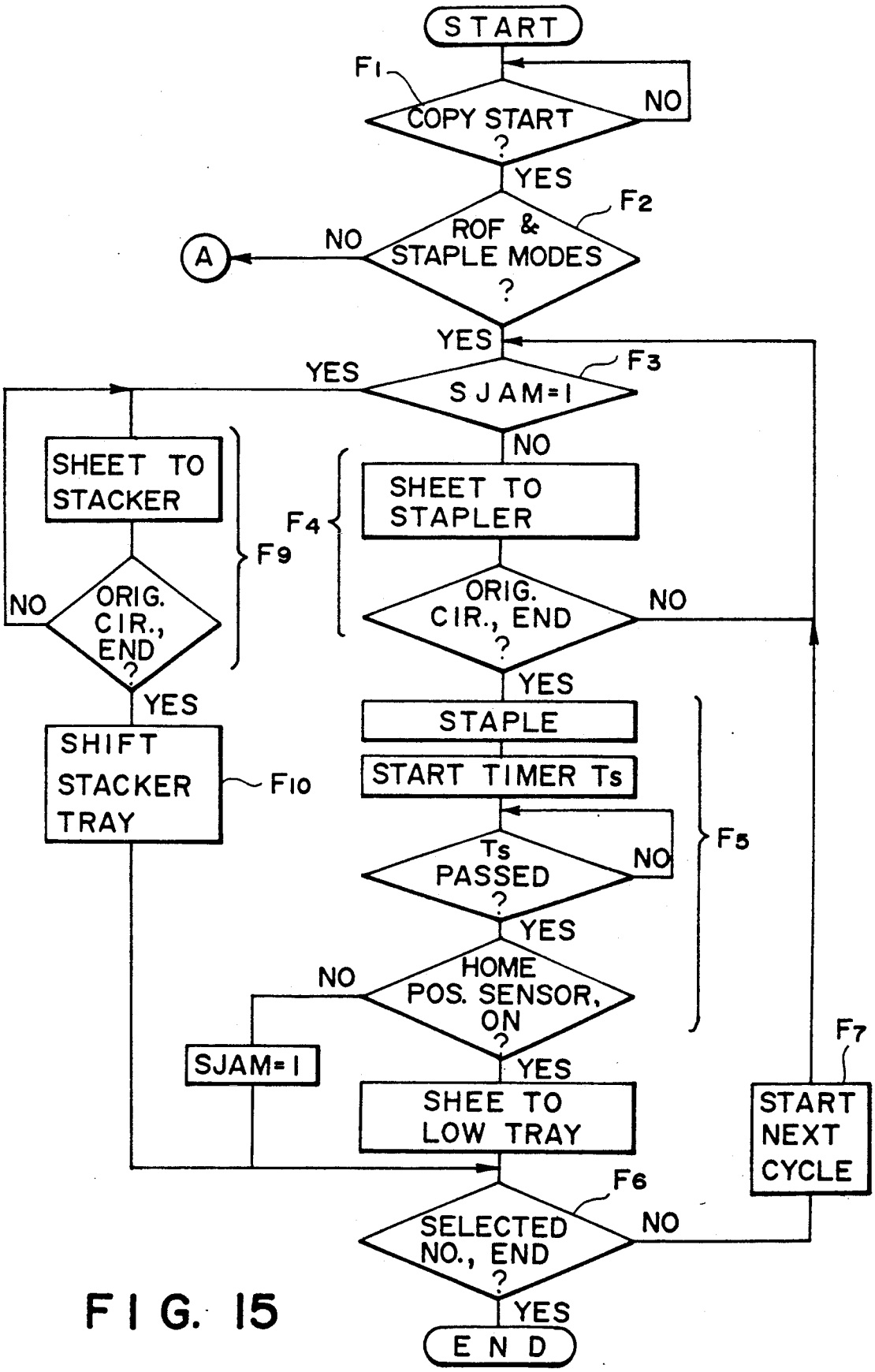
FIG. 15 is a flow chart illustrating operation when the stapler malfunctions.

Referring to FIG. 14, the description will be made as to operations upon the malfunction of the stapler of the sheet finisher unit U. When the start of the copying operation of the copying machine 10 is detected at step Fl, the holding device 1 and the finisher device 7 are placed under the operative conditions, instantaneously. Next, at step F2, the description is made as to whether or not the mode is an RDF feeder using and stapling mode. If not, the sequence branches out to flow "A", which however is not directly connected with the present invention, and therefore the detailed explanation of which is omitted. At step F3, the discrimination is made as to whether or not a stapler jam (SJAM) occurred in the past. If not, the inlet deflector 43 is switched by the solenoid 94 to discharge the sheet to the stapler station 6 at step F4.

After the sheet P is discharged to the stapling station 6, the discrimination is performed as to whether or not the originals on the RDF feeder have circulated one cycle by the original cycle sensor 206. If not, the sequence goes back to step F3, and the operation is continued until one cycle is completed. If completed, the sequence goes to step F5, where the sheets are stapled, and a timer Ts is started. If the home position sensor 311 is not actuated after the timer period Ts elapses, that is, the stapler main assembly 304 is not restored to its home position, it is deemed that a stapler jam occurred and a jam flag SJAM is set to 1. At step F6, the description is made as to whether or not the preset number of copies has been taken or not. If no stapler jam is detected, the solenoid 99 is actuated to rotate the stepper 40, so that the stapled sheets are allowed to fall onto the bottom tray 41, and the sequence advances to step F6.

If the preset number of copies are produced, the operation ends. If not, the next copying operation is prepared at step 7, and the sequence goes back to F3, and then, the above described operations are repeated until the preset number of copies are reproduced. Even if the occurrence of the stapler jam is detected, the operation ends if the preset number of copies are taken (step F6). However, even in this case, it is desirable that a clear warning is produced to the operator. If the preset number of copies are not taken, the steps F7 and F3 are repeated, and then at step F9, the solenoid 95 is actuated to switch the inlet deflector 43, by which the subsequent set of sheets are discharged to the stacker station 5 which is capable of accommodating a larger number of sheets, until one cycle of the original circulation is completed.

When the one cycle is completed, the stacker station 5 is horizontally shifted by actuating the motor M3 at step F10 so as to make easier the subsequent sorting operation of the sheets P. Then, at step F6 (through steps F7 and F3 if the preset number of copies are not taken), the subsequent sheets are all discharged to the stacker station 5 and are stacked thereon with lateral shifts for respective sets of copies.

In the foregoing embodiment, the description has been made with respect to a sheet finisher unit U connected with a copying machine 10 equipped with an automatic document feeder of a recirculation type (RDF). However, the present invention is not limited to this case, but is applicable to the copying machine provided with an automatic document feeder capable of automatically supplying the originals to a predetermined reading station of the copying machine.

Next, the description will be made with respect to the case where an automatic document feeder wherein the original is not circulated is utilized, and where plural number of copies are selected on an operation panel 175, and further where a stapling mode is selected.

Figure 16:
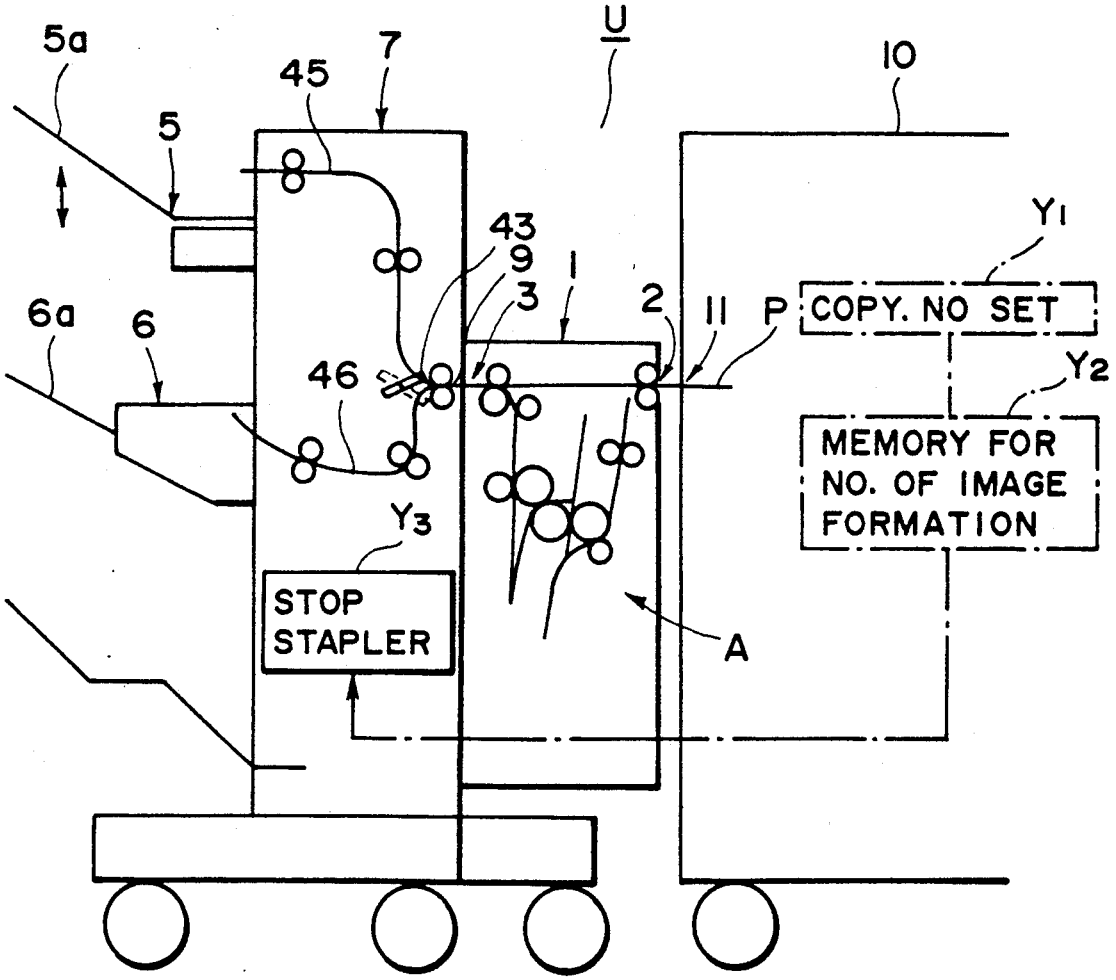
FIG. 16 is a block diagram for the control to prevent stapling of the same copies together.

As shown in FIG. 16, in this example, the finisher device 7 is provided with means Y2 for memorizing the number of image forming operations, which actuates the automatic document feeder, and it is effective to store the number of copies, the number of image forming operations, set in the copy number selector Y1 of the copying machine 10 when the stapling mode is selected. The finisher device 7 is further provided with means Y3 for prohibiting stapling operation, which is effective to prohibit the stapler from operating to staple plural copy sheets P from the same original image on the basis of the memory of the pluralism of the set number and to flicker a lamp 63 to provide an warning with the operator.

Figure 17:
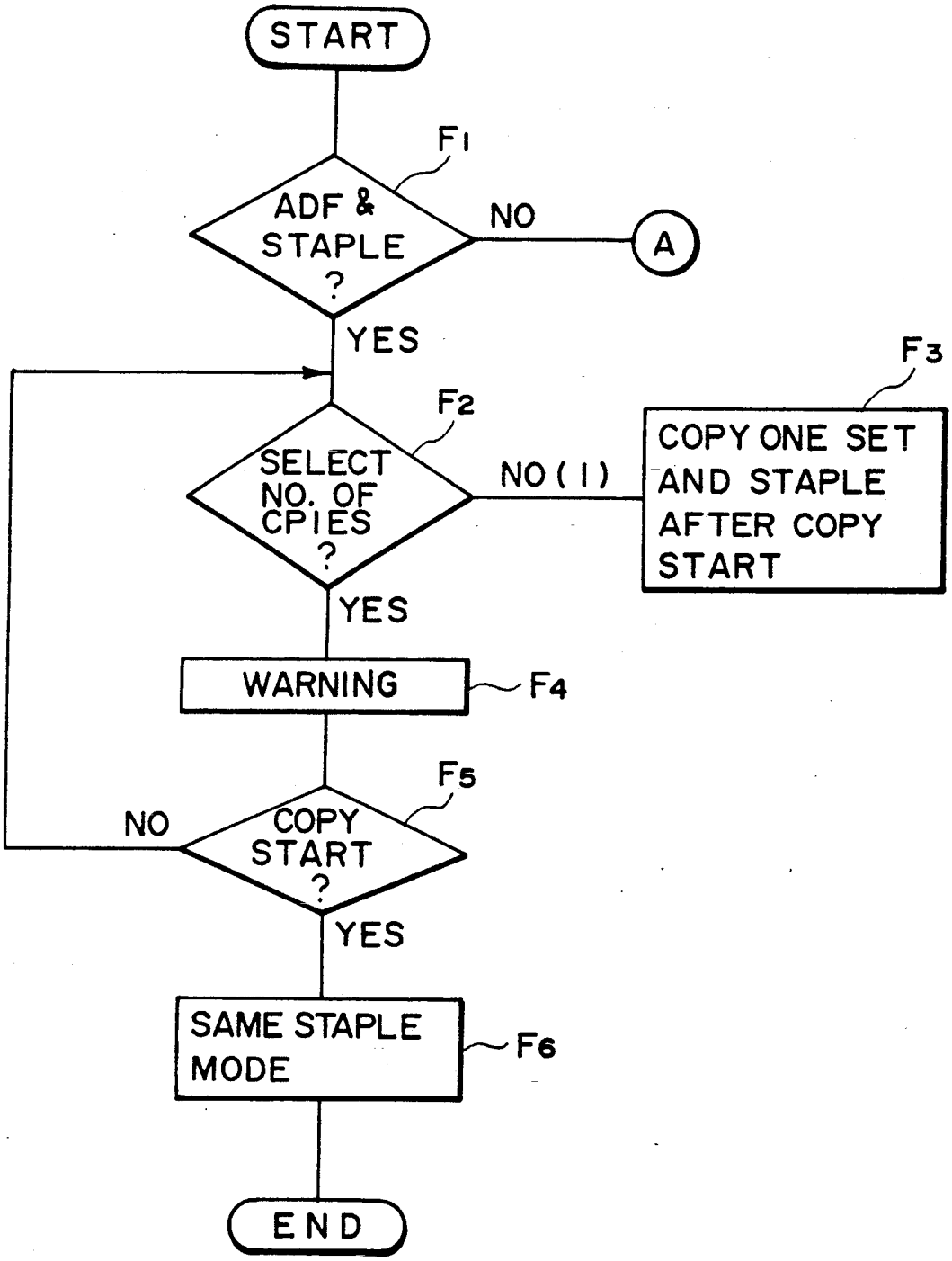
FIG. 17 is a flow chart illustrating the control of FIG. 16.

Referring to FIG. 17, the operation will be described. At step Fl, the discrimination is made as to whether or not the mode is an ADF feeder using and stapling mode. If so, the discrimination is made, at step F2, as to whether or not the number of copies to be taken is plural, by the image formation number memorizing means Y2. If the result of the step Fl is negative, the sequential flow branches out to "A", which however is not directly concerned with the present invention, and therefore, detailed explanation of which is omitted for the sake of simplicity. If the number of copies set at step F2 is single, that is, 1, the sequence goes to step S3, where one copy is produced from one original, and the copy sheet P is discharged onto the intermediate tray *6a*, and this is repeated. After completion of the sheet discharging for all the originals, the discharged copy sheets are stapled, and the operation ends (normal ADF operation).

If, however, at step F2 it is discriminated that the image formation number memorizing means Y2 stores a plural number of copies preset by the copy number selector Y1, some warning is produced to the operator at step F4. Simply, for example, the display lamp 63 representing the selection of stapling mode is flickered on the operation panel 60 of FIG. 6. If the copying machine is provided with a liquid crystal display (LCD) by which a sentence can be displayed, "same copy sheets are to be stapled" or "check the preset number" may be displayed. Then, the sequence goes to step F6, and if the operator desires the stapling mode copy despite the display, and depresses the copy start button, the sequence goes to step F6 from the step F5, and a preset number of copies is produced for each of the originals. After the preset number of copies are produced, the copy sheets are stapled, and the operations are repeated until the ADF feeder becomes empty. At step F5, if it is prior to the start of copying operation, the sequence goes back to step F2, and the rechecking is effected as to whether it is the intentional preset number or not, and the above described control is continued. This is so done, in consideration of the possibility that the operator will reconsider whether to set the number to In the foregoing embodiment, when plural number of copies is memorized, the display 63 or the like is lit on to give an warning to the operator. However, it is a possible alternative to prohibit the copying operation of the copying machine 10. Another alternative is that the preset number is automatically reset to 1, and the copying operation is automatically performed, assuming automatically that the number is 1.

Figure 2:
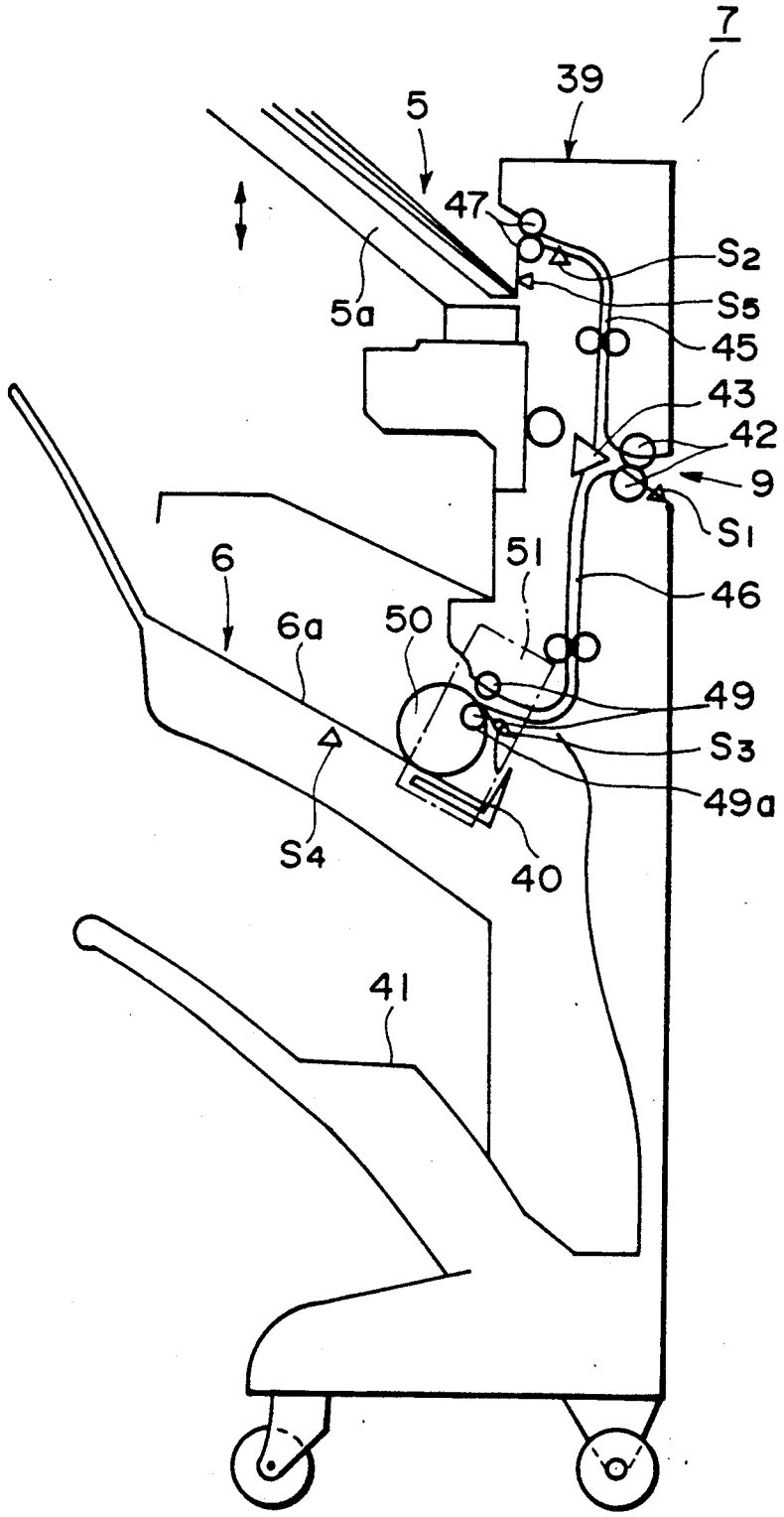
FIG. 2 is a sectional view of a sheet finisher containing a stapler and a stacker.
Figure 18:
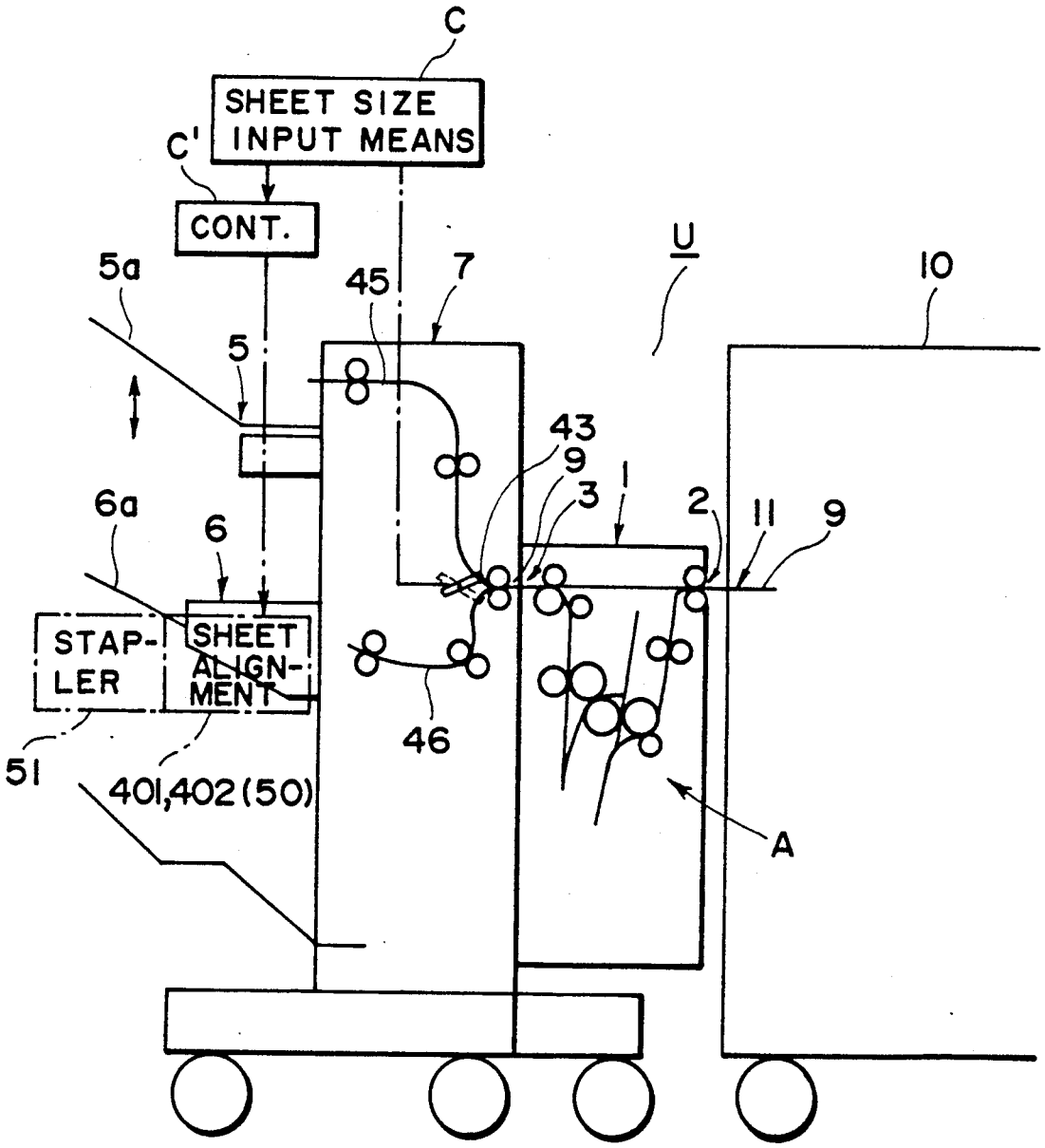
FIG. 18 is a block diagram for illustrating the control for a sheet aligning means.
Figure 19A:
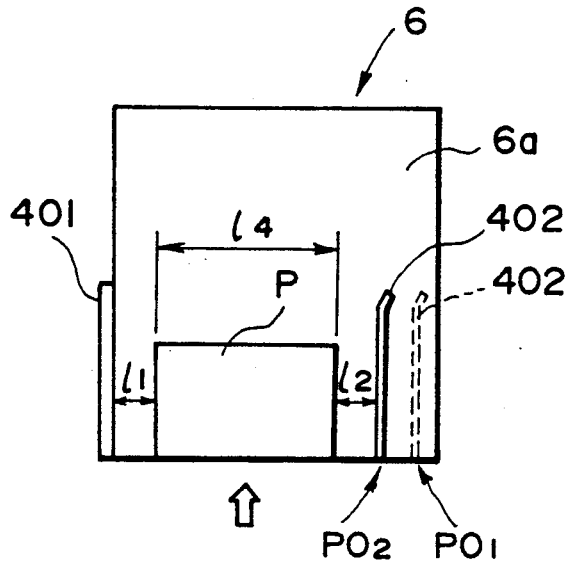
FIGS. 19A, 19B and 19C illustrate operation of the sheet aligning means.
Figure 19B:
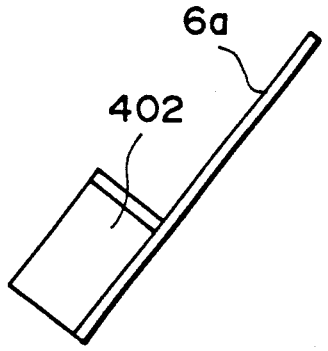
Figure 19C:
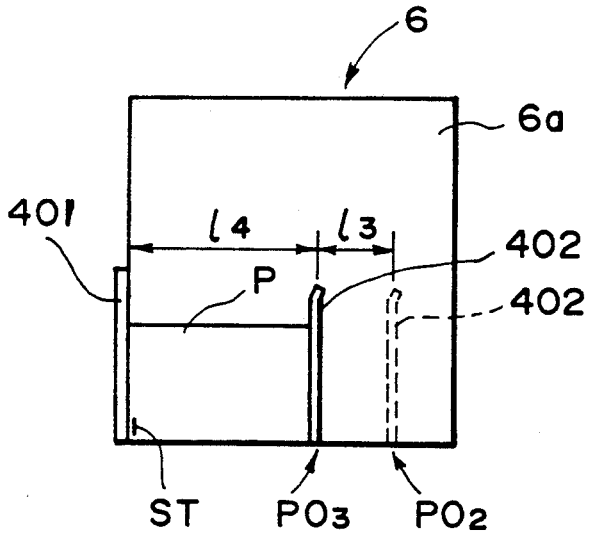

Referring to FIGS. 18 and 19A, B and C, the description will be made as to the alignment of the sheets on the intermediate tray. As shown in FIG. 19A, the intermediate tray *6a* is provided with a sheet aligning means including a reference or sheet abutting plate 401 and a sheet aligning plate 402. The sheet abutting plate 401 is fixed at one lateral end of the intermediate tray *6a*. The sheet aligning plate 402 is laterally shiftable by a pulse motor in accordance with the sheet size signal from the sheet size sensor 161*a* and 162*a* of the cassette or under the control of control means C' when the copy sheet is fed manually which will be described. The control means is effective to control the sheet aligning plate 402 on the basis of the sheet size signal from a sheet size input means C which will be described hereinafter. When the copying operation of the copying machine 10 starts, the sheet aligning plate 402 is displaced laterally to a position PO2 corresponding to the size 14 of the sheet P to be discharged onto the intermediate tray *6a*. The position PO2 is predetermined on the basis of each of the sheet sizes, as shown in FIG. 19A. The size signal is provided to the motor on the basis of the selected cassette or deck for supplying the sheet in the copying machine 10 or a sheet size input means for inputting the size of the manually fed sheet which will be described hereinafter. The distance 11 between the sheet P and the sheet abutting plate 401 shown in FIG. 19A and a distance 12 between the sheet aligning plate 402 shifted to the predetermined position PO2 and the sheet P is approximately 5 mm, respectively. When, the sheet P is discharged onto the intermediate tray *6a*, and is detected by the intermediate tray sensor S4, the sheet aligning plate 402 moves from the predetermined position PO2 to a sheet urging position PO3 prior to the sheet becoming still. And then, the sheet aligning plate 402 is returned to the predetermined position PO2. For each discharges of the sheet P onto the intermediate tray *6a*, the sheet aligning plate 402 moves and returns, so that the sheets P are aligned at their lateral edges. As shown in FIG. 2, the stapling means, i.e., the stapler 52 is disposed above the lower end of the intermediate tray *6a*, and the sheets P on the intermediate tray *6a* are stapled at a position ST adjacent to the sheet abutting plate 401 shown in FIG. 19C.

Figure 20:
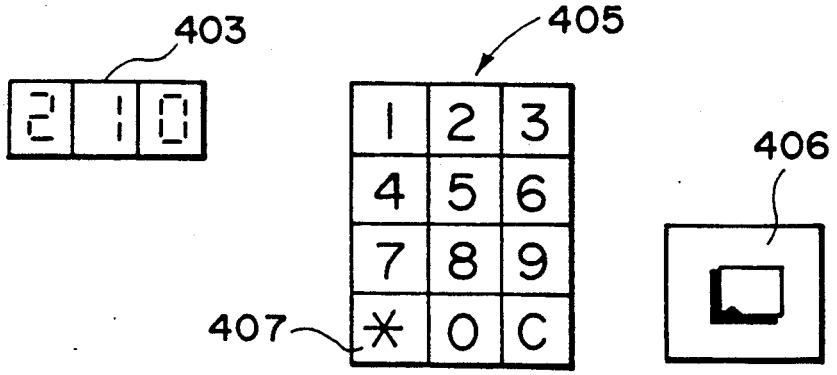
FIG. 20 shows a part of operating portion of an image forming apparatus.

As shown in FIG. 20, the operation panel 175 is provided with a copy number display 403, ten keys 405, copy start button 406 and others. When the copy number is inputted by the ten keys 405, the number is displayed on the copy number display 403. When the copy button 406 is depressed, the copy operation starts. When the sheet is to be stapled, the stapling mode is selected. When the copy sheet is manually supplied, the size of the sheet or sheets manually supplied is inputted by a sheet size inputting means C. The inputting means is provided in the copying machine or in the sheet finisher unit and is constituted by ten keys or dial. It is possible that the ten keys 405 are commonly used. In order to make distinction from the number of copies, the width of the sheet to be manually fed is inputted by first depressing an asterisk key 407 of the ten keys 405, then inputting the width by the ten keys 405 and finally depressing the asterisk key 407 again. For example, when the size of the sheet is 297 mm, "* 207 *" is inputted.

As an alternative way of inputting, when an A4 size sheet, for example, is conveyed in its lateral direction, "* 4 *" is inputted; and when it is supplied longitudinally, "* 4 **" may be inputted. In the former case, any folding mode is neglected. However, the apparatus may be so constructed that when the size of A3 is inputted, the sheet can be folded as in the case that the sheet is supplied from the cassette or the like.

When the sheet P is supplied from the sheet supplying station of the copying machine 10, more particularly, from the sheet cassette 161 or 162 or from the deck 163, and when the stapling mode is selected, the sheet P introduced through a predetermined passage from the sheet inlet 9 by the conveying roller couple 42 is introduced to a stapler conveying passage 46 by the inlet deflector 43, and is once discharged onto the intermediate tray 6a by the stapler discharging roller couple 49. The sheet P is then aligned in the longitudinal and lateral directions and placed on the intermediate tray 6a.

The sheets P thus placed in order on the intermediate tray 6a are stapled by the stapler 51. Subsequently, the sheets stapled by rotation of the stopper 40 are allowed to fall on the lower tray 41 and are accommodated there.

Figure 21:
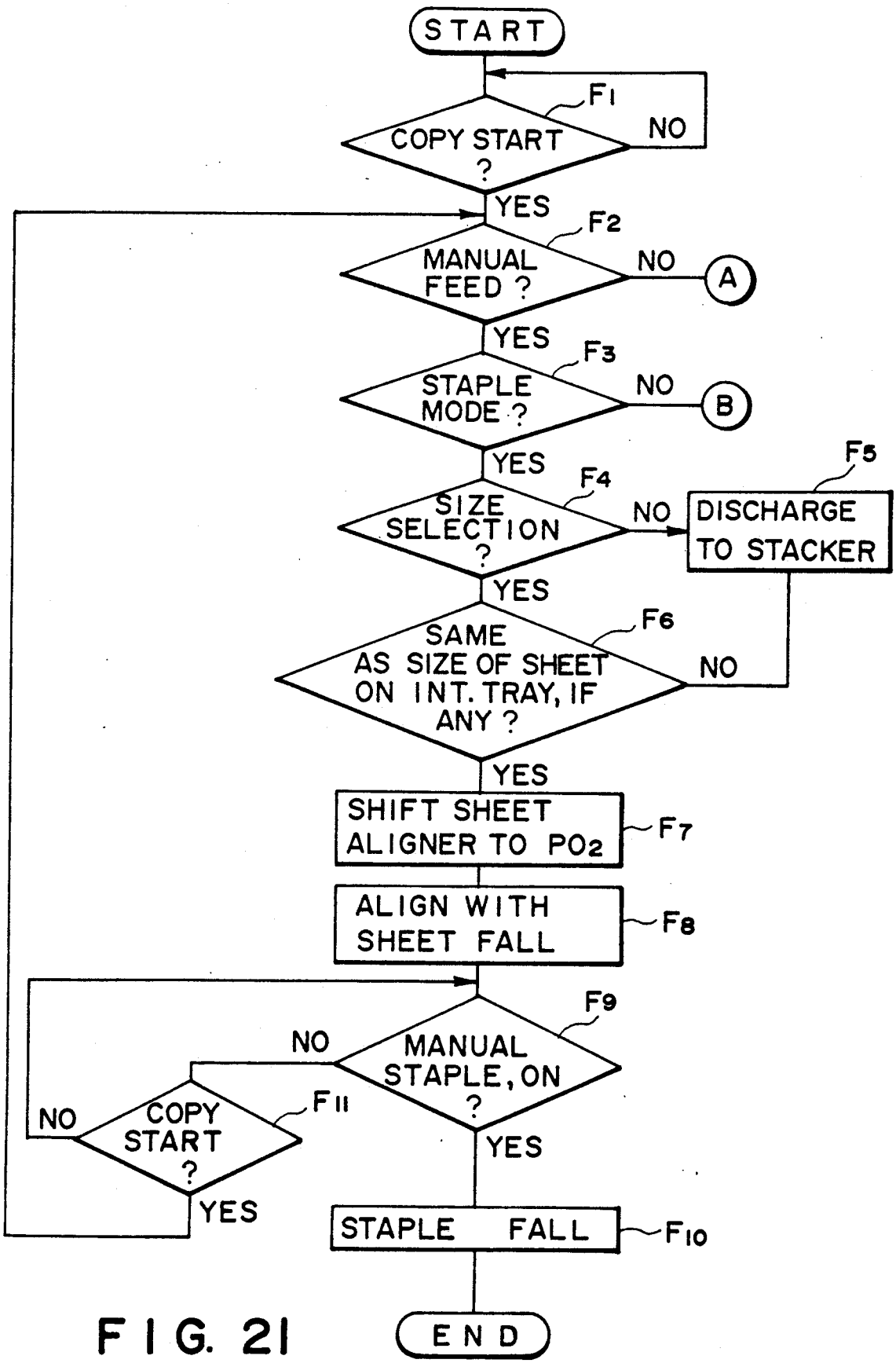
FIG. 21 illustrating a control of the sheet aligning means.

Referring to FIG. 21, the operation when a sheet is manually fed into the copying machine 10 will be described. When the start of the copying operation of the copying machine 10 is detected (Fl), the folding device 1 and the finisher device 7 are placed under operative conditions. When the manual feeding and stapling mode is selected (F2, F3), the discrimination is made as to whether or not the size of the copy sheet to be manually fed is inputted or not (F4). If either one of the manual feeding mode or stapling mode is not selected, the sequential flow goes to A or to B, which is not directly concerned with the feature of this embodiment, and therefore, the description of which is omitted. If there is no sheet size input, the sheet P introduced to the finisher device 7 through a predetermined passage is discharged onto the stacker station 5 at step F5. At this time, it is possible that the copying operation of the copying machine 10 is prohibited. The case of the sheet size inputted will be described. When a sheet is already present at the intermediate tray 6a, the discrimination is made as to whether or not the size of the sheet on the intermediate tray 6a is the same as the inputted sheet size at step F6. If not, the sheet introduced into the finisher device 7 is discharged to the stacker station 5 (F5). If the sizes are the same, the sheet aligning plate 72 of the intermediate tray 6a is shifted to a position PO2 corresponding to the sheet size inputted, at step F7. The sheet P is guided by the inlet deflector 43 switched to the stapler passage 46 side, and is aligned on the intermediate tray 6a at step F8. When a manual stapling button is depressed at step F9, the sheets are stapled by the stapler 51, and then are allowed to fall onto the lower tray 41 where they are accommodated there at step F10. If the copying operation is started (Fl) with the manual stapling button not depressed, after the sheet is aligned on the intermediate tray 6a, the above described operations are repeated.

Now, the description will be made with respect to the case where mixed A3 and A4 size sheets are fed from the automatic document feeder.

Figure 22:
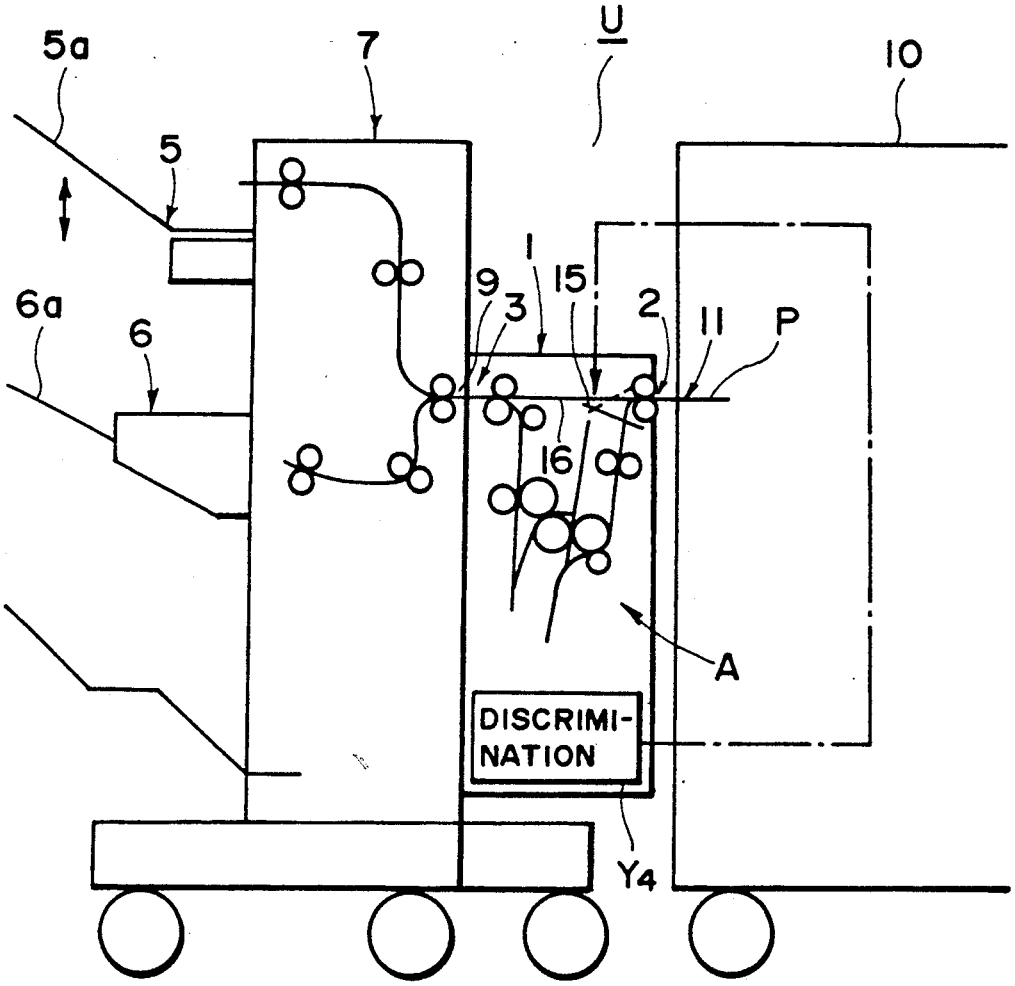
FIG. 22 is a block diagram for the control of the sheet folding means.

As shown in FIG. 22, the sheet finisher unit according to this embodiment of the present invention is provided with means Y4 for discriminating necessity and unnecessity of sheet folding. In this embodiment, the function of the discriminating means Y4 is performed by the microcomputer MC of FIG. 7. When mixed size originals are fed by the RDF or ADF feeder, the size of the original is detected by the sensors 202 and 203 shown in FIGS. 1 and 7, and the microcomputer MCO is responsive to the detection signal thereof or to a copy magnification inputted on the operation panel 175 and the detection signal thereof, and to select that one of cassettes 161, 162 and deck 163 which accommodates a corresponding size of sheets. And, the feeding means is controlled so as to feed out the sheet from the selected cassette or deck.

Figure 23:
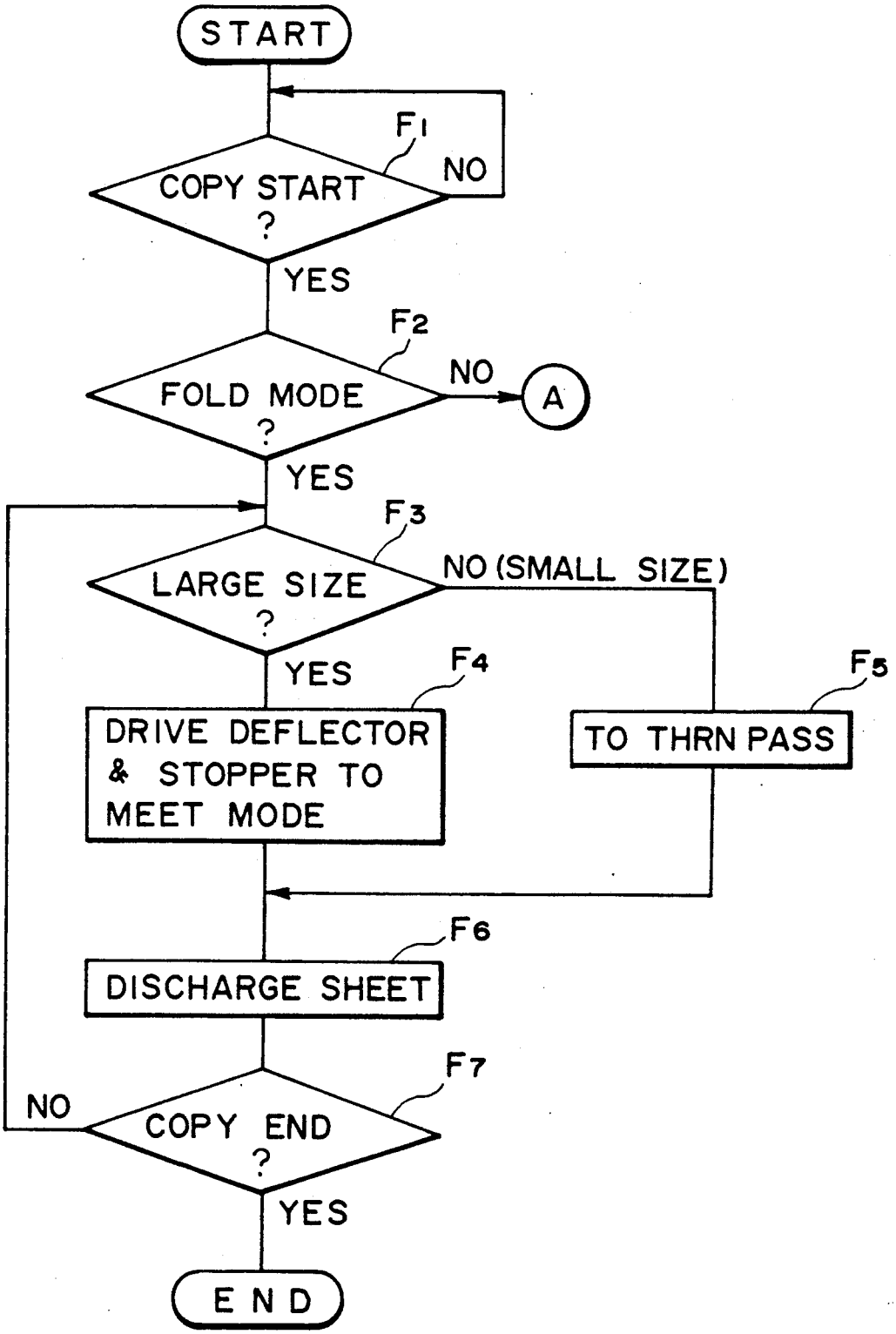
FIG. 23 is a flow chart illustrating the control of FIG. 22.

Referring to FIG. 23, the operation will be explained. At step Fl, the start of the copying operation is detected, and instantaneously, the folding device and the finisher device 7 are placed under operative conditions. At step F2, the description is made as to whether or not the mode is the folding mode. If not, the sequence goes to the flow "A", which, however, is not directly concerned with this embodiment, and therefore, the description of which is omitted for the sake of simplicity.

At step F3, the discriminating means Y4 discriminates in accordance with the sheet size signal from the main body of the image forming apparatus whether or not the folding is needed. As described hereinbefore, the sheet size is detected using the original size detecting sensors 202 and 203 of the RDF feeder or using the sheet size sensors 161a and 162a of the selected cassette.

If it is such a large size sheet P as to be folded, the deflectors and stoppers of the folding device 1 are set to meet the folding mode, at step F4. If the discrimination at step F3 is negative, i.e. unnecessity of the folding, that solenoid of the groove of solenoids 115 (FIG. 7) which controls the inlet deflector 15 is controlled at step F5 to switch the inlet deflector 15 to direct the sheet to the through passage 16. Subsequently, at step F6 the sheet P is discharged from the folding device 1, and at step F7 the discrimination is made as to whether or not the copying operation ends. If not, the sequence goes back to step F3, and the above described operations are repeated. If so, the folding operation ends, too.

It is possible to discriminate the necessity or unnecessity of the sheet folding depending on the property or thickness of the sheet in addition to the size of the sheet. For example, it is seldom that a transparent resin sheet used for an overhead projector (OHP) is folded. In this case, the transparency of the sheet can be detected by a combination of a light source and a photocoupler, and the discrimination is made depending on the output of the photosensor as to the sheet is the OHP sheet or not. In response to the signal, the inlet deflector 15 is switched.

Figure 24A:
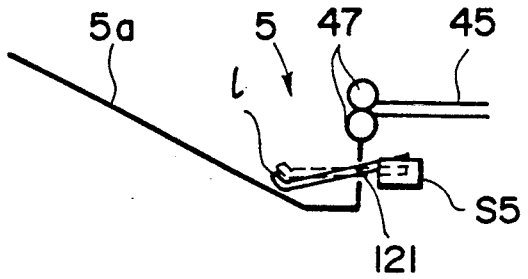
FIGS. 24A, 24B, 24C, 24D and 24E illustrate the operation of the stacker of a sheet finisher.
Figure 24D:
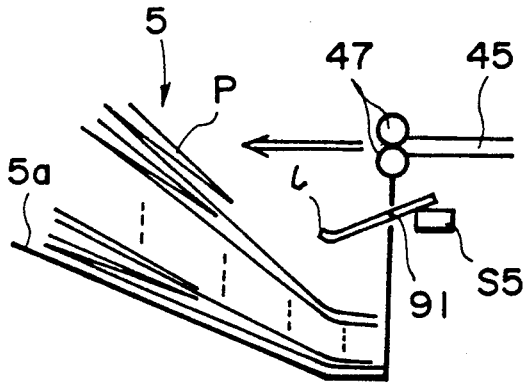
Figure 24B:
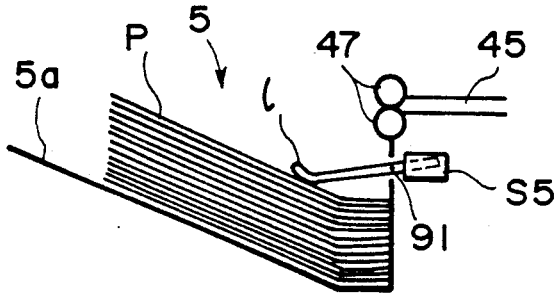
Figure 24E:
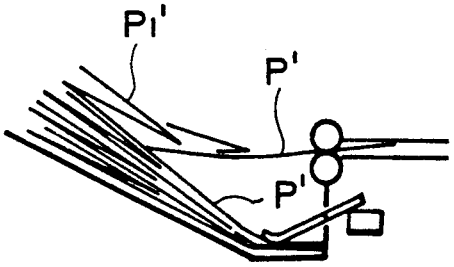
Figure 24C:
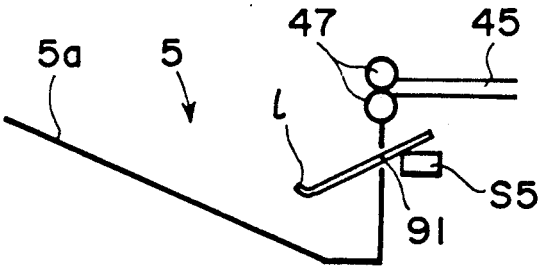
Figure 25:
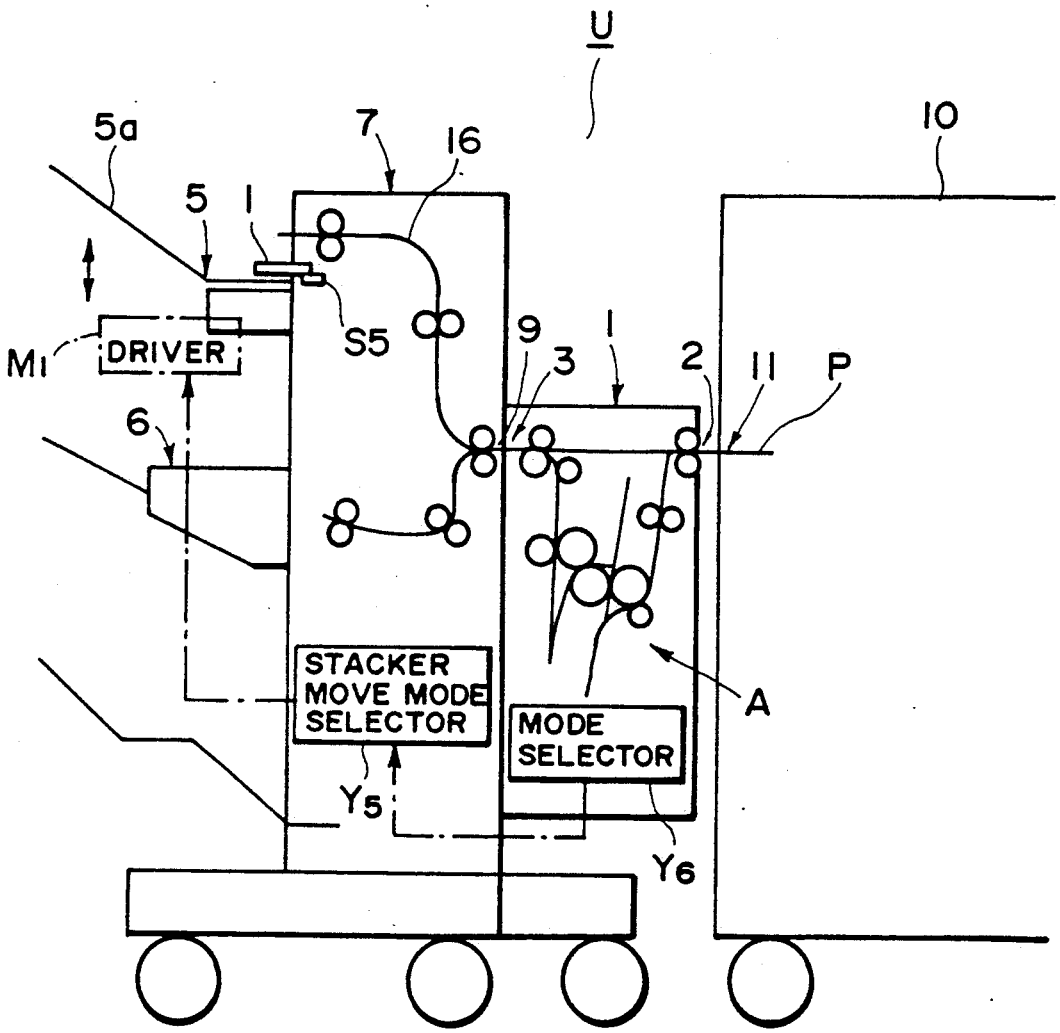
FIG. 25 is a block diagram for the control of the stacker.

Referring to FIGS. 24A–E and 25, the stacker 5 for stacking the copy sheets will be described. As shown in FIG. 24A, the stacker station 5 is provided with a lever 1 which is disposed to the stacker 5a and which is rotatable about a pivot 121. The free end of the lever 1 is received by the stacker 5a itself or a sheet or sheets on the stacker 5a, and when it is raised to such an extent that the back end thereof is detected by a level detecting sensor S5, by which the existence of the stacker 5a at the lever position is detected. The stacker 5a moves substantially vertically and stops in predetermined moving modes under the control of a stacker movement mode setting means Y5. The mode setting means Y5 is responsive to the modes of the folding device 1 to transmit a signal to a motor Ml for driving the stacker 5a, so that the initial position for receiving the first sheet by the stacker 5a and an amount of lowering in accordance with the stacking actions of the sheets, are set.

Figure 26:
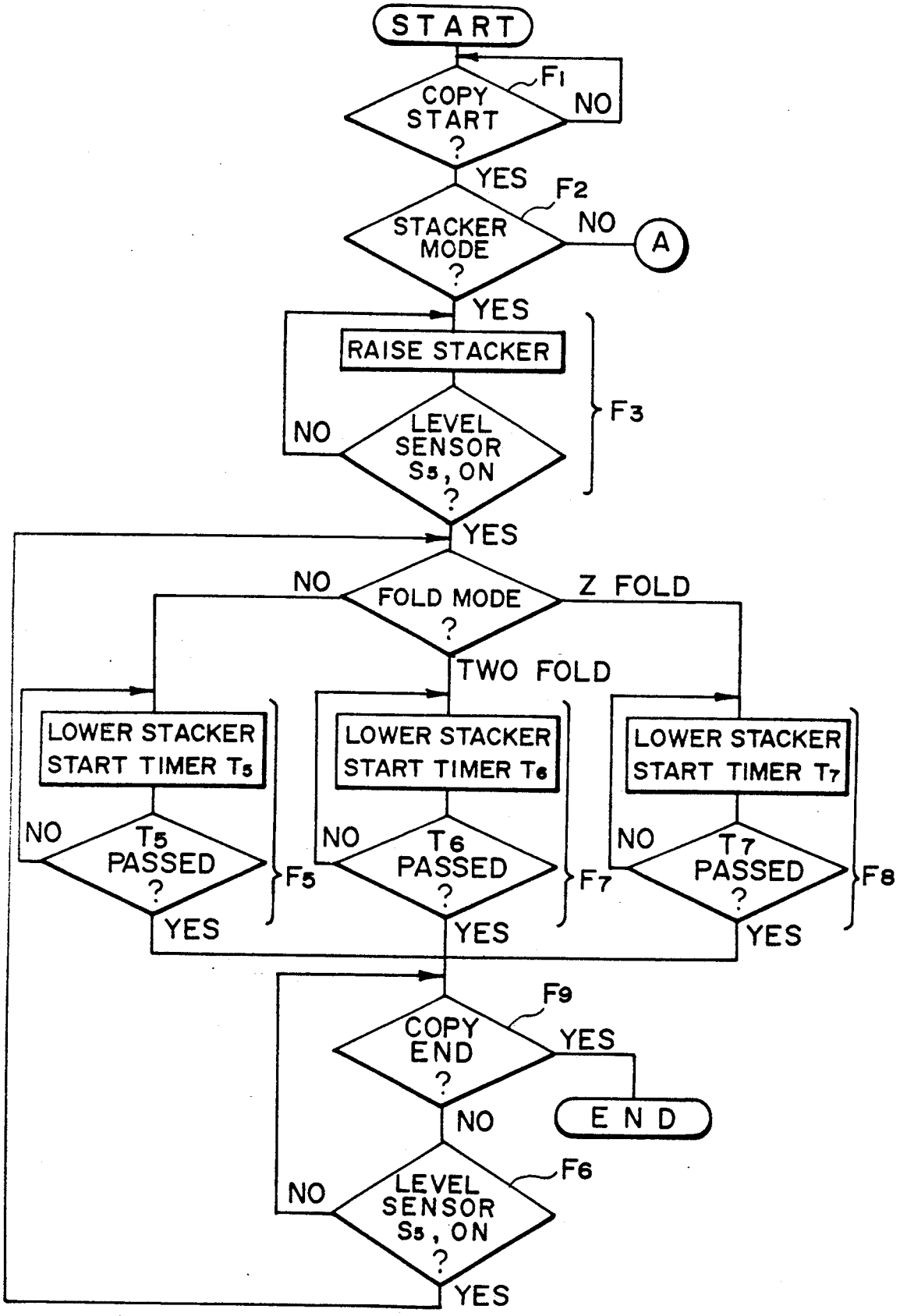
FIGS. 26 and 27 are flow chart for the control of the stacker.

Referring to FIG. 26; the operation of the stacker 5 will be described in conjunction with the flow chart of this Figure. When the copy start button is depressed on the operation panel 175 (FIG. 7) at step F1, and when a stacker mode is selected on the operation panel 60 (FIG. 7) or is selected for the finisher device 7 at step F2, the stacker 5*a* is lifted to the topmost position (the solid line lever 1 position) detectable by the level detecting sensor S5 under the control of the stacker movement mode setting means Y5. When non-folding mode is selected for the folding device 1, for example, the first through pass mode or the second mode, is selected at step F4, the stacker 5*a* is lowered for a predetermined period of time T5 to an initial position (the solid line lever 1 position) which is the position at which the stacker 5*a* becomes not detected by the level detecting sensor, and is stopped there, at step F5. Then, the sheet P is introduced from the sheet inlet 9 by the conveying roller couple 42 and is directed by the inlet deflector 43 to the stacker passage 45, and is discharged and stacked on the stacker 5*a*, sequentially. When the height of the stack of sheets is so increased that the lever 1 rotates to actuate the level detecting sensor S5, at step F6, the stacker 5*a* is slightly lowered and is stopped at a position not actuating the level detecting sensor S5, and the sheet is continued to be discharged. In this manner, a great amount of sheets P can be stacked on the stacker 5*a* (FIG. 2B), at step F5. When a sheet folding mode, for example the third, fourth or fifth mode is selected at step F4, the stacker 5*a* is lifted to a position detected by the level detecting sensor S5 in the same manner as described above (F3), and thereafter, as shown in FIG. 24C, the stacker 5*a* is moved for a predetermined period of time T6 or T7 to a predetermined position (initial position) which is considerably lower than the initial position in the case of the above described non-folding mode (F7 or F8). The lowering period is preferably set to be proper period T6 or T7, depending on the selected mode between the two-folding mode and z-folding mode. When the folded sheets P are sequentially discharged and stacked on the stacker 5*a* (FIG. 2D), and therefore, the height of the folded sheets P increases so that the lever 1 actuates the level detecting sensor S5 (F6), the stacker 5*a* lowers through a distance predetermined depending on the folding modes (F7 or F8). Then, the subsequent folded sheets P are continuously stacked. In this manner, the sheet P is discharged without being obstructed by the folded sheets already stacked on the stacker 5*a*. The above described operations are repeated until the copying operation ends (F9).

Figure 27:
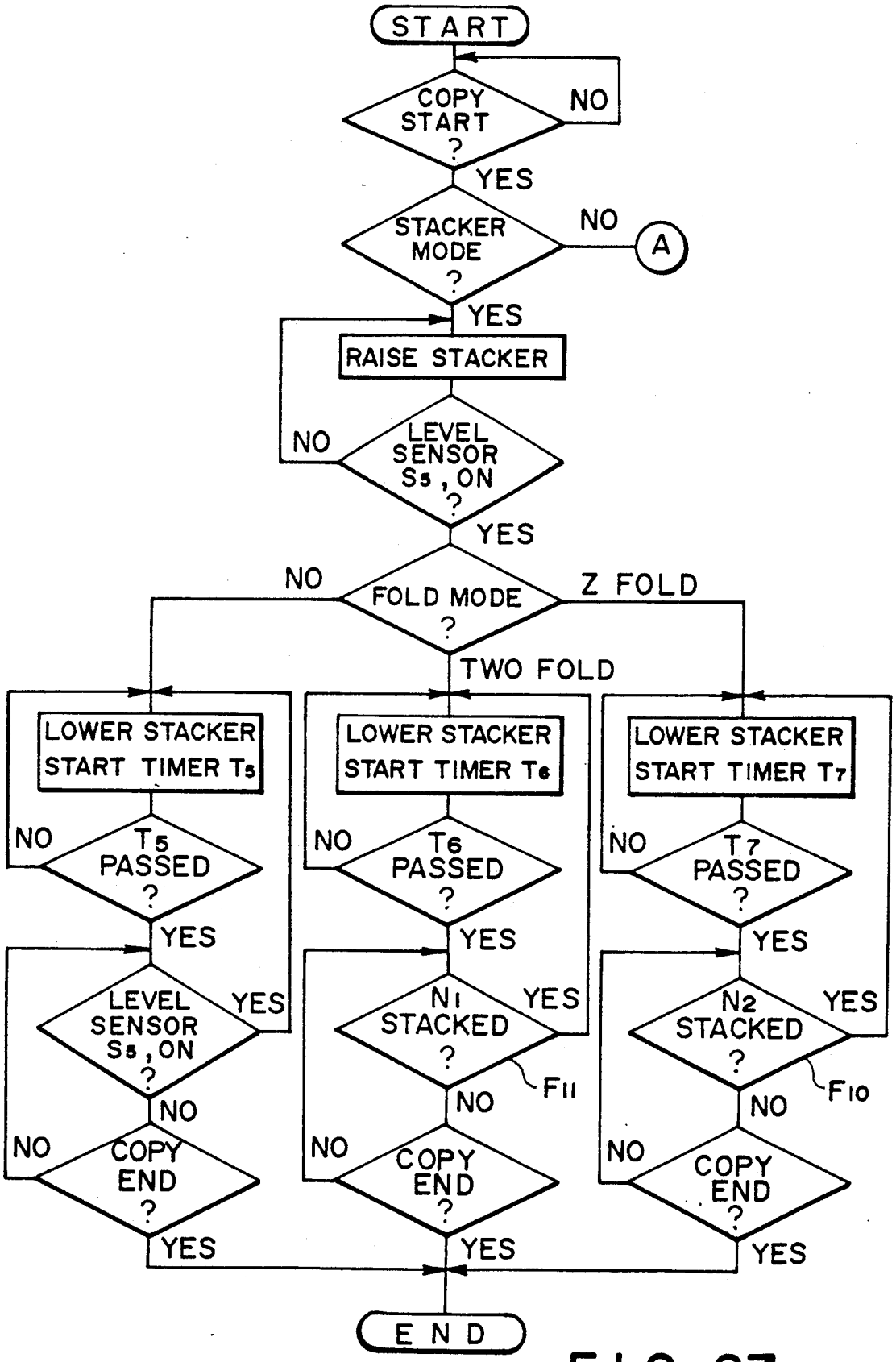

As shown in FIG. 27, the lowering amounts are determined on the basis of the folding modes, as follows. For example, in the case of the z-folding mode, the stacker is lowered through 3 mm (the predetermined period T7) for each five sheets (N2), and in the case of the two-folding mode, it is lowered through 2 mm for each five sheets (N1) (the predetermined time T6). In this alternative, the stacker 5 is lowered not depending on the level detecting sensor S5 but by the number of sheets discharged.

While the invention has been described with reference to the structures disclosed herein, it is not confined to the details set forth and this application is intended to cover such modifications or changes as may come within the purposes of the improvements or the scope of the following claims.

What is claimed is:

1. A sheet finisher apparatus usable with an image forming apparatus which forms images of originals on sheets, comprising:

means for stacking sheets;

means for stapling sheets;

switching means for receiving sheets from the image forming apparatus and for conveying them selectively to said sheet stacking means or to said stapling means;

means for counting the number of sheets to said stapling means by counting the number of originals of the image forming apparatus; and control means for controlling said switching means to convey the sheets to said stapling means until a count of said counting means reaches a predetermined number, and for conveying the sheets to said stacking means thereafter.

2. An apparatus according to claim 1, wherein said stapling means includes a tray for stacking the sheets coming from said switching means.

3. An apparatus according to claim 1, wherein said image forming apparatus is provided with an original feeding device including means for accommodating originals and means for feeding the originals from said accommodating means, and the images of the originals are formed on the sheets.

4. A sheet finisher apparatus, comprising:

means for stacking sheets;

means for stapling sheets;

switching means for receiving sheets and conveying the sheets selectively to said stacking means or to said stapling means;

means for detecting a malfunction of said stapling means and producing a signal representing the malfunction; and control means for controlling said switching means in response to the signal from said detecting means to convey the sheets to said sheet stacking means.

5. An apparatus according to claim 4, wherein said stapling means includes a staple accommodating portion for accommodating staples for stapling the sheets.

6. An apparatus according to claim 5, wherein said detecting means produces the malfunction signal in response to absence of the staple in the accommodating portion.

7. An apparatus according to claim 4, wherein said stapling means includes a main stapling assembly movable between an operative position and an inoperative position, wherein said malfunction detecting means produces the malfunction signal when said stapling means does not return from the operative position to the inoperative position in a predetermined period of time after start of a stapling operation.

8. An image forming apparatus, comprising:

means for forming images on sheets;

stapling means for stapling the sheets on which images are formed by said image forming means;

instruction means for giving said image forming means instructions including forming the same images on two or more sheets continuously and producing a signal representing the instruction; and means for prohibiting operation of said stapling means in response to the signal produced by said instruction means.

9. An apparatus according to claim 8, further comprising means for producing a warning signal when said prohibiting means prohibits operation of said stapling means.

10. A sheet finisher apparatus usable with an image forming apparatus, comprising:

means for aligning sheets received by said sheet finisher apparatus to form an aligned bundle of sheets;

stapling means for stapling the bundle of sheets aligned by said aligning means;

means for detecting an image formation mode to which the image forming apparatus is set and in which mode formation of the same images on two or more sheets of the bundle is included; and means for prohibiting operation of said stapling means in response to said detecting means detecting the mode.

11. A sheet aligning apparatus, comprising:

a tray for receiving sheets;

a sheet aligning member movable between a waiting position which is away from a lateral end of the sheets on said tray and an operative position wherein it abuts the later end of the sheet to position the sheet to a predetermined position;

means for producing a signal representing a size of the sheet to be received by said tray; and control means for controlling the waiting position in response to the signal from said signal producing means.

12. An apparatus according to claim 11, wherein said signal producing means includes means for selecting sizes of sheets.

13. An apparatus according to claim 11, wherein said sheet aligning apparatus is used with an apparatus including means for forming images on the sheets and means for supplying sheets to said image forming means.

14. An apparatus according to claim 13, wherein said sheet supplying means includes a sheet container for containing the sheets, and wherein said signal generating means detects the size of the sheet contained in the sheet container to produce the signal representing the size of the sheets.

15. A sheet finisher apparatus, comprising:

sheet folding means for folding sheets;

means for receiving sheets that are unfolded or sheets that are folded by said folding means;

stacking means for stacking the sheets discharged from said receiving means;

means for moving said stacking means substantially vertically;

means for controlling said moving means to effect control of said moving means in one manner for the folded sheets and in another manner for unfolded sheets.

16. An apparatus according to claim 15, wherein said control means provides different amounts of movements of said stacking means for the folded sheets and unfolded sheets.

17. An image forming apparatus, comprising:

means for supplying sheets;

means for forming images on the sheets supplied by said sheet supplying means;

means for stacking the sheets on which images have been formed;

means for stapling the sheets;

switching means for receiving sheets from said image forming means and for conveying them selectively to said sheet stacking means or to said stapling means;

means for counting the number of sheets to said stapling means by counting the number of originals of the image forming apparatus; and control means for controlling said switching means to convey the sheets to said stapling means until a count of said counting means reaches a predetermined number, and for conveying the sheets to said stacking means thereafter.

18. An apparatus according to claim 17, wherein said image forming means forms images of originals on the sheets.

19. An image forming apparatus comprising:

means for forming images of originals on the sheets supplied by said sheet supplying means;

means for stacking the sheets on which images have been formed;

means for stapling the sheets;

switching means for receiving sheets from said image forming means and for conveying them selectively to said sheet stacking means or to said stapling means;

means for counting the number of sheets to said stapling means by counting the number of originals of the image forming apparatus; and control means for controlling said switching means to convey the sheets to said stapling means until a count of said counting means reaches a predetermined number, and for conveying the sheets to said stacking means thereafter; and a conveying passage for conveying the sheets from said switching means to said stapling means; and further comprising means for accommodating originals and means for feeding the originals from said accommodating means, wherein said counting means counts number of originals fed out of said original feeding means to count the number of sheets to said stapling means.

20. A sheet finisher apparatus usable with an image forming apparatus wherein a first set of copies is provided by circulating a set of originals and a second set of copies is provided by recirculating the set of originals, comprising:

means for stacking sheets;

means for stapling sheets;

switching means for receiving sheets from the image forming apparatus and for conveying them selectively to said sheet stacking means or to said stapling means;

means for counting the number of sheets to said stapling means; and control means for controlling said switching means to convey the sheets to said stapling means until a count of said counting means reaches a predetermined number, and for conveying all subsequent sheets, including sheets of the first set, if any and the subsequent set, to said stacking means thereafter.

21. An apparatus according to claim 20, wherein said stacking means is substantially horizontally movable to sort the sheets.

22. A sheet finisher apparatus; comprising:

means for stacking sheets;

means for stapling sheets;

switching means for receiving sheets from the image forming apparatus and for conveying them selectively to said sheet stacking means or to said stapling means;

means for counting the number of sheets to said stapling means by counting the number of originals of the image forming apparatus;

control means for controlling said switching means to convey the sheets to said stapling means until a count of said counting means reaches a predetermined number, and for conveying the sheets to said stacking means thereafter; and accommodating means for receiving and accommodating the sheets stapled by said stapling means;

wherein said stapling means includes a tray for stacking the sheets coming from said switching means.

23. An apparatus according to claim 22, wherein said stacking means is at a topmost level, and said accommodating means is at a bottommost level, and wherein said tray is therebetween.

24. A sheet finisher apparatus, comprising:

means for circulating plural originals;

means for detecting one full circulation of the originals;

means for forming images of the original sheets;

means for stacking sheets;

means for stapling sheets;

switching means for receiving sheets and conveying them selectively to said sheet stacking means or to said stapling means;

means for counting the number of sheets to said stapling means; and control means for controlling said switching means to convey the sheets to said stapling means until a count of said counting means reaches a predetermined number, and for conveying the sheets to said stacking means, when the predetermined number is reached, and said detecting means does not detect the one full circulation.

25. A sheet finisher apparatus, comprising:

means for circulating plural originals;

means for forming images of the originals on sheets;

means for stacking sheets;

means for stapling sheets;

switching means for receiving sheets and conveying them selectively to said sheet stacking means or to said stapling means;

means for counting the number of originals to count the number of sheets to be conveyed to said stapling means, by circulating prior to the start of the copying operation the originals without image formation; and control means for controlling said switching means to convey the sheets to said stacking means when the number of the originals counted by said counting means prior to the start of the copying operation exceeds a staplable number by said stapling means.

26. An image forming apparatus wherein a first set of copies is provided by circulating a set of originals and a second set of copies is provided by recirculation the set of originals, comprising:

means for supplying sheets;

means for forming images on the sheets supplied by said sheet supplying means;

means for stacking sheets;

means for stapling sheets;

switching means for receiving sheets and conveying them selectively to said sheet stacking means or to said stapling means;

means for counting the number of sheets to said stapling means; and control means for controlling said switching means to convey the sheets to said stapling means until a count of said counting means reaches a predetermined number, and for conveying all subsequent sheets, including sheets of the first set, if any fed and the subsequent set, to said stacking means thereafter.

27. An image forming apparatus comprising:

means for supplying sheets;

means for forming images on the sheets supplied by said sheet supplying means;

means for stacking sheets, said stacking means being substantially horizontally movable to sort the sheets;

means for stapling sheets;

switching means for receiving sheets and conveying them selectively to said sheet stacking means or to said stapling means;

means for counting the number of sheets to said stapling means; and control means for controlling said switching means to convey the sheets to said stapling means until a count of said counting means reaches a predetermined number, and for conveying all of said sheet and subsequent sheets to said stacking means thereafter.

28. An image forming apparatus which forms images of originals on sheets, comprising:

means for supplying sheets;

means for forming images on the sheets supplied by said sheet supplying means;

means for stacking sheets;

means for stapling sheets;

switching means for receiving sheets and conveying them selectively to said sheet stacking means or to said stapling means;

means for counting the number of sheets to said stapling means by counting the number of originals of the image forming apparatus;

control means for controlling said switching means to convey the sheets to said stapling means until a count of said counting means reaches a predetermined number, and for conveying the sheets to said stacking means thereafter; and accommodating means for receiving and accommodating the sheets stapled by said stapling means;

wherein said stapling means includes a tray for stacking the sheets coming from said switching means.

29. An apparatus according to claim 28, wherein said stacking means is at a topmost level, and said accommodating means is at a bottommost level, and wherein said tray is therebetween.

30. An image forming apparatus comprising:

means for supplying sheets;

means for forming images on the sheets supplied by said sheet supplying means;

means for circulating plural originals;

means for forming images of the originals on sheets;

means for stacking sheets;

means for stapling sheets;

switching means for receiving sheets and conveying them selectively to said sheet stacking means or to said stapling means;

means for counting the number of originals to count the number of sheets to be conveyed to said stapling means by circulating prior to the start of the copying operation the originals without image formation; and control means for prohibiting the copying operation when the number of the originals exceeds a staplable number by said stapling means.

31. An image forming apparatus, comprising:

means for supplying sheets;

means for forming images on the sheets supplied by said sheet supplying means;

means for circulating plural originals;

means for detecting one full circulation of the originals;

means for forming images of the originals sheets;

means stacking sheets;

means for stapling sheets;

switching means for receiving sheets and conveying them selectively to said sheet stacking means or to said stapling means; and means for counting the number of sheets to said stapling means; and control means for controlling said switching means to convey the sheets to said stapling means until a count of said counting means reaches a predetermined number, and for conveying the sheets to said stacking means, when the predetermined number is reached, and said detecting means does not detect the one full circulation.

32. An image forming apparatus, comprising:

means for supplying sheets;

means for forming images on the sheets supplied by said sheet supplying means;

means for circulating plural originals;

means for forming images of the originals on sheets;

means for stacking sheets;

means for stapling sheets;

switching means for receiving sheets and conveying them selectively to said sheet stacking means or to said stapling means;

means for counting the number of originals to count the number of sheets to be conveyed to said stapling means by circulating prior to the start of the copying operation the originals without image formation; and control means for controlling said switching means to convey the sheets to said stacking means when the number of the originals counted by said counting means prior to the start of the copying operation exceeds a staplable number by said stapling means.

* * * * *

UNITED STATES PATENT AND TRADEMARK OFFICE

CERTIFICATE OF CORRECTION

PATENT NO. 5,032,876

DATED July 16, 1991

INVENTOR(S) Koichi Murakami

It is certified that error appears in the above-identified patent and that said Letters Patent is hereby corrected as shown below:

In the Drawings:

FIGURE 15:

"SHEE TO" should red --SHEET TO--.

COLUMN 1:

Line 52, "is" should be deleted;

Line 53, delete "away from"; and

Line 55, "lossed" should read --lost--.

COLUMN 4:

Line 23, "illustrating" should read --illustrates--; and

Line 33, "chart" should read --charts--.

COLUMN 5:

Line 1, "rollers 164, 164" should read --rollers 164, 165--.

UNITED STATES PATENT AND TRADEMARK OFFICE

CERTIFICATE OF CORRECTION

PATENT NO. : 5,032,876

DATED : July 16, 1991

INVENTOR(S) : Koichi Murakami

It is certified that error appears in the above-identified patent and that said Letters Patent is hereby corrected as shown below:

COLUMN 10:

Line 43, "buffers 75 and 75" should read --buffers 75 and 76--.

COLUMN 11:

Line 22, delete "is".

COLUMN 12:

Line 5, "copies sheets" should read --copied sheets--; and

Line 67, "circulating" should read --circulated--.

COLUMN 15:

Line 62, "to" should read --to 1--.

COLUMN 21:

Line 48, "vertically;" should read --vertically; and--.

COLUMN 23:

Line 57, "recirculation" should read --recirculating--.

UNITED STATES PATENT AND TRADEMARK OFFICE

CERTIFICATE OF CORRECTION

PATENT NO. : 5,032,876 Page 3 of 3

DATED : July 16, 1991

INVENTOR(S) : Koichi Murakami

It is certified that error appears in the above-identified patent and that said Letters Patent is hereby corrected as shown below:

COLUMN 24:

Line 5, "fed" should be deleted; and

Line 24, "sheet" should read --sheets--.

COLUMN 25:

Line 11, "originals" should read --original--; and

Line 12, "means" should read --means for--.

Signed and Sealed this

Thirteenth Day of April, 1993

*Attest:*

STEPHEN G. KUNIN

*Attesting Officer*

*Acting Commissioner of Patents and Trademarks*